US008629817B2

(12) United States Patent
Abe et al.

(10) Patent No.: US 8,629,817 B2
(45) Date of Patent: Jan. 14, 2014

(54) DRIVING CIRCUIT OF DISPLAY ELEMENT AND IMAGE DISPLAY APPARATUS

(71) Applicant: Canon Kabushiki Kaisha, Tokyo (JP)

(72) Inventors: Katsumi Abe, Kawasaki (JP); Masafumi Sano, Yokohama (JP); Ryo Hayashi, Yokohama (JP); Hideya Kumomi, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 13/740,318

(22) Filed: Jan. 14, 2013

(65) Prior Publication Data

US 2013/0127812 A1 May 23, 2013

Related U.S. Application Data

(63) Continuation of application No. 12/162,929, filed as application No. PCT/JP2007/055152 on Mar. 8, 2007.

(30) Foreign Application Priority Data

Mar. 10, 2006 (JP) ..... 2006-065902

(51) Int. Cl.
*G09G 3/30* (2006.01)
*G09G 5/10* (2006.01)

(52) U.S. Cl.
USPC ..... 345/76; 345/690

(58) Field of Classification Search
USPC ..... 345/76, 690
See application file for complete search history.

(56) References Cited

U.S. PATENT DOCUMENTS

| | | | |
|---|---|---|---|
| 6,373,454 | B1 | 4/2002 | Knapp et al. |
| 7,145,532 | B2 | 12/2006 | Kageyama et al. |
| 7,221,343 | B2 | 5/2007 | Kageyama et al. |
| 7,379,044 | B2 | 5/2008 | Kageyama et al. |
| 2003/0112208 | A1 | 6/2003 | Okabe et al. |
| 2004/0207614 | A1 | 10/2004 | Yamashita et al. |
| 2005/0156832 | A1 | 7/2005 | Ono |
| 2007/0194379 | A1 | 8/2007 | Hosono et al. |

FOREIGN PATENT DOCUMENTS

| | | | |
|---|---|---|---|
| EP | 1 034 530 | B1 | 1/2004 |
| EP | 1 439 520 | A2 | 7/2004 |
| JP | 2000-227769 | A | 8/2000 |
| JP | 2002-517806 | A | 6/2002 |
| JP | 2003-223136 | A | 8/2003 |
| JP | 2003-330415 | A | 11/2003 |
| JP | 2003-330416 | A | 11/2003 |
| JP | 2004-246320 | A | 9/2004 |
| JP | 2005-173142 | A | 6/2005 |
| WO | 99/65011 | A2 | 12/1999 |
| WO | 2005/088726 | A1 | 9/2005 |

OTHER PUBLICATIONS

International Search Report and Written Opinion in PCT/JP2007/055152.

*Primary Examiner* — Jonathan Boyd
*Assistant Examiner* — Randal Willis
(74) *Attorney, Agent, or Firm* — Fitzpatrick, Cella, Harper & Scinto

(57) ABSTRACT

A new driving circuit is provided. The driving circuit according to the present invention comprises a first period for setting a current to be supplied to a display element, a second period for setting a gray-scale of the display element, and a third period for supplying a driving current to the display element. The present invention, in the driving circuit of the display element, is provided with a current source circuit for supplying a constant current to the display element and a control circuit for controlling the time to supply a constant current to the display element from the current source circuit.

14 Claims, 19 Drawing Sheets

DRIVING CIRCUIT OF DISPLAY ELEMENT AND IMAGE DISPLAY APPARATUS

This application is a continuation of application Ser. No. 12/162,929, filed on Jul. 31, 2008.

TECHNICAL FIELD

The present invention relates to a driving circuit of a display element for driving the display element of an organic electroluminescence (hereinafter, referred to as EL) element and the like and an image display apparatus using the same.

BACKGROUND ART

Heretofore, an active-matrix (hereinafter, referred to as AM) type organic EL display has been studied as a light emitting display element provided with a pixel comprising an organic EL element and a driving circuit in a matrix pattern.

FIG. 23 illustrates a structure of the pixel, and FIG. 24 illustrates a structure of the AM type organic EL display. In the AM type organic EL display, a gray-scale (gradation) control is performed by controlling light emission intensity.

It is pointed out that a voltage-light emission characteristic of the organic EL element changes with time and the characteristic of a thin film-transistor (hereinafter, referred to as TFT) used in the driving circuit varies.

Hence, to realize a display without variation, it is necessary to use a driving circuit and driving method which are hardly affected by time aging of the organic EL element characteristic and the characteristic variation of the TFT.

As a first technique to solve this problem, a driving circuit as illustrated in FIG. 25 has been proposed (for example, Japanese Patent Application Laid-Open No. 2002-517806; corresponding to International Publication WO99/65011).

While the characteristic variation of the TFT can be regarded as variation between the threshold value and mobility, in the first technique, a current is supplied from the outside to the TFT (Tr1) which is short-circuited between a gate and a drain inside the driving circuit. By so doing, the gate of the TFT can be set to the voltage in which the current is let flow from the outside according to the threshold value and mobility of the TFT.

After that, when a current channel is directed to an organic EL element LED1 after the gate voltage is held, the voltage between the gate and the source of the TFT becomes the same as the voltage in which the current is let flow from the outside. Hence, the TFT acts as a current source for supplying a constant current of the same magnitude as the current from the outside, and can let flow a current of the same magnitude as the current from the outside to the organic EL element.

Consequently, in the first technique, if there is no variation in the current from the outside, regardless of the characteristic variation of the TFT, a constant current can be supplied to the organic EL element, so that a uniform display can be performed.

Further, as a second technique to solve the above described problem, a driving circuit illustrated in FIG. 26 has been proposed (For example, Japanese Patent Application Laid-Open No. 2003-223136). The second technique is provided with a voltage comparator (CMP) and a switch TFT (Tr1) to which output of the voltage comparator is connected to the gate and the source and drain are connected to the power source and the organic EL element LED1.

In the second technique, after a reference analogue voltage is held in the input of the voltage comparator, sweep voltages of a suitable range are applied in order. The voltage comparator outputs a voltage of high level (low level) if the sweep voltage increases (decreases) as compared with the reference voltage, and can control ON/OFF of the application of the voltage to the organic EL element since the Switch TFT turns ON/OFF.

Consequently, the light emission time of the organic EL element can be controlled by an applied waveform of the sweep voltage, and a multi-gray-scale display can be performed.

DISCLOSURE OF THE INVENTION

Currently, the improvement of the current-luminance characteristic of the organic EL element is on the upswing, and the supply current to the organic EL element is lowering.

Consequently, particularly in the case of the low current corresponding to low gray-scale, in the first technique, it takes a long time for an operation to set the gate of the TFT inside the driving circuit to a voltage in which the current from the outside is let flow according to the threshold value and mobility of the TFT, and thus, it is difficult to apply the technique to a large screen display element.

On the other hand, in the second conventional technique, since the voltage is applied to the organic EL element by the switching TFT inside the driving circuit, there is a problem that the lowering of luminance due to deterioration of the voltage-luminance characteristic of the organic EL element cannot be addressed.

An object of the present invention is to provide a driving circuit of a display element and an image display apparatus using the same, which can not only be applied to an image display apparatus of a large screen, but also can deal with the deterioration of the voltage-luminance characteristic of the display element.

The driving circuit according to the present invention is comprising a first period for setting a current to be supplied to the display element, a second period for setting a gray-scale of the display element, and a third period for supplying a driving current to the display element. The present invention, in the driving circuit of the display element, is provided with a current source circuit for supplying a constant current to the display element and a control circuit for controlling the time for supplying a constant current to the display element from the current source circuit.

The current source circuit comprises a holding circuit for holding a value according to a constant current to be supplied to the display element during the first period, and controls a time for supplying a constant current to the display element from the current source circuit during the third period according to the gray-scale voltage supplied during the second period.

A feature of the first aspect of the present invention is a driving circuit for performing a driving control including a first period for setting a current to be supplied to the display element, a second period for setting a gray-scale of the display element, and a third period for supplying a driving current to the display element, comprising:

a current source circuit having a first transistor and a holding circuit for holding a gate voltage of the first transistor during the first period at the voltage according to a constant current to be supplied to the display element; and a control circuit including a second transistor for switching the current to the display element from the current source circuit, a third transistor whose one terminal is connected to a gate of the second transistor, and a capacitor element whose one end is connected to a gate of the third transistor and the other end is connected to a line, and controlling the emission time of the display element by controlling the second transistor during the third period;

wherein, during the second period, an electric charge is accumulated in the capacitor element based on the difference between a gray-scale voltage supplied to the capacitor element from the line and a threshold voltage of the third transistor, and wherein, during the third period, an ON voltage is applied to the gate of the second transistor, and a sweep voltage is applied to the capacitor element from the line, so that the ON time of the second transistor is controlled.

A feature of the second aspect of the present invention is a driving circuit for performing a driving control including a first period for setting a current to be supplied to the display element, a second period for setting a gray-scale of the display element, and a third period for supplying a driving current to the display element, comprising:

a current source circuit having a first transistor and a holding circuit for holding a gate voltage of the first transistor during the first period at the voltage corresponding to a constant current to be supplied to the display element; and a control circuit including a second transistor for switching the current to the display element from the current source circuit, a third transistor whose one terminal is connected to a gate of the second transistor, and a capacitor element whose one end is connected to a gate of the third transistor and the other end is connected to an line, and controlling the emission time of the display element by controlling the second transistor during the third period;

wherein, during the second period, a constant voltage is applied from the line and after that, a gray-scale voltage is applied, and an electric charge is accumulated in the capacitor element based on the difference between the gray-scale voltage and a threshold value voltage of the third transistor; and wherein, during the third period, an ON voltage to turn on the second transistor is applied to the gate of the second transistor through the third transistor, and after that, a sweep voltage is applied to the capacitor element from the line, so that the ON time of the second transistor is controlled.

A feature of the third aspect of the present invention is a driving circuit of a display element including a first period for setting a current to be supplied to the display element, a second period for setting a gray-scale of the display element, and a third period for supplying a driving current to the display element, comprising:

a current source circuit having a first transistor and a holding circuit for holding a gate voltage during the first period at the voltage corresponding to a constant current to be supplied to the display element, and a control circuit having a second transistor connected in series to the first transistor and a capacitor element whose one end is connected a gate of the second transistor and the other end is connected to a line and controlling the light emission time of the display element by controlling the second transistor during the third period, wherein, during the second period, an electric charge based on the difference between a gray-scale voltage supplied to the capacitor element from the line and a gate voltage of the second transistor is accumulated, and wherein a weep voltage is applied to the capacitor element from the line during the third period, so that the ON time of the second transistor is controlled.

A feature of the fourth aspect of the present invention is a driving circuit of a display element including a first period for setting a current to be supplied to the display element, a second period for setting a gray-scale of the display element, and a third period for supplying a driving current to the display element, comprising:

a current source circuit having a first transistor and a holding circuit for holding a gate voltage of the first transistor during the first period at the voltage corresponding to a constant current to be supplied to the display element, and a control circuit including the second transistor connected in series to the current source circuit and connected in parallel to the display element and the capacitor element whose one terminal is connected to a gate of the second transistor and the other terminal is connected to a line, and controlling the light emission time of the display element by controlling the second transistor during the third period, wherein the constant voltage is applied from the line during the first period, wherein the gray-scale voltage is applied from the line during the second period, and moreover, the gate of the second transistor and the one terminal are short-circuited, and the electric charge based on the difference between the gray-scale voltage and the gate voltage of the second transistor is accumulated in the capacitor element, and wherein, during the third period, a sweep voltage is applied from the line, so that the ON time of the second transistor is controlled.

A feature of the fifth aspect of the present invention is a driving circuit for performing a driving control including a first period for setting a current to be supplied to the display element, a second period for setting a gray-scale of the display element, and a third period for supplying a driving current to the display element, comprising:

a current source circuit having a first transistor and a holding circuit for holding a gate voltage of a gate of the first transistor during the first period at an electric potential corresponding to a constant current to be supplied to the display element, and a control circuit including the second transistor for switching the current to the display element from the current source circuit, and a third transistor whose one terminal is connected to a gate of the second transistor, and a capacitor element whose one end is connected to a gate of the third transistor and the other end is connected to a line through a switch, and controlling the light emission time of the display element by controlling the second transistor during the third period, wherein, during the second period, an electric charge based on the difference between a gray-scale voltage supplied to the capacitor element from the line and a threshold voltage of the third transistor is accumulated, and wherein, during the third period, an ON voltage is applied to the gate of the second transistor, and a sweep voltage is applied to the capacitor element, so that the ON time of the second transistor is controlled.

Further, the image display apparatus according to another aspect of the invention is wherein in that the driving circuit and display element according to the first to fifth aspects of the present invention are disposed on a substrate in a matrix pattern.

According to the present invention, a new driving circuit can be provided, which can be also applied to the image display apparatus of a large screen, and at the same time, can reduce the variation of luminance due to the deterioration of the voltage-luminance characteristic of the display element.

Further features of the present invention will become apparent from the following description of exemplary embodiments with reference to the attached drawings.

A feature of another aspect of the present invention is the driving circuit of the display element according to the first to fifth aspects of the present invention, wherein a current source is provided in the control circuit, and the current source generates the sweep voltage in the control circuit by supplying or removing a charge to or from one end of the capacitor element.

A feature of another aspect of the present invention is the driving circuit of the display element according to the first to fourth aspects of the present invention, wherein, in the second transistor, the constant current is a current in a sub threshold region, and an OFF current is equal to or less than 0.1% of the constant current.

A feature of another aspect of the present invention is a driving circuit of a display element including a first period for setting a current to be supplied to the display element, a second period for setting a gray-scale of the display element, and a third period for supplying a driving current to the display element, comprising:

a current source circuit having a holding circuit for holding a value corresponding to a constant current to be supplied to the display element during the first period; and a control circuit controlling a time of supplying the constant current to the display element from the current source circuit during the third period, according to a gray-scale voltage supplied during the second period, wherein the current source circuit includes at least a first transistor, wherein the control circuit includes a second transistor whose source and drain are connected in series between the current source circuit and the display element, whose gate is connected to one end of a capacitor element directly or through a switch, in which the constant current is in a sub threshold region of a gate voltage-drain current characteristic, and in which an OFF current is equal to or less than 0.1% of the constant current, and wherein, during the third period, the time of supplying the constant current to the display element is controlled by time-dependently changing a gate voltage of the second transistor and thus controlling an ON time between the source and the drain of the second transistor.

A feature of another aspect of the present invention is a driving circuit of a display element including a first period for setting a current to be supplied to the display element, a second period for setting a gray-scale of the display element, and a third period for supplying a driving current to the display element, comprising:

a current source circuit having a holding circuit for holding a value corresponding to a constant current to be supplied to the display element during the first period; and a control circuit controlling a time of supplying the constant current to the display element from the current source circuit during the third period, according to a gray-scale voltage supplied during the second period, wherein the current source circuit includes at least a first transistor, wherein the control circuit includes a second transistor whose source and drain and the display element are connected in parallel with respect to the current source circuit, whose gate is connected to one end of a capacitor element directly or through a switch, in which the constant current is in a sub threshold region of a gate voltage-drain current characteristic, and in which an OFF current is equal to or less than 0.1% of the constant current, and wherein, during the third period, the time of supplying the constant current to the display element is controlled by time-dependently changing a gate voltage of the second transistor and thus controlling an OFF time between the source and the drain of the second transistor.

Although only some exemplary embodiments of this invention have been described in detail above, those skilled in the art will readily appreciated that many modifications are possible in the exemplary embodiments without materially departing from the novel teachings and advantages of this invention. Accordingly, all such modifications are intended to be included within the scope of this invention.

BEST MODES FOR CARRYING OUT THE INVENTION

Next, the best mode for carrying out the present invention will be described below in detail with reference to the accompanying drawings. Incidentally, in the following exemplary embodiments, while a description will be made on the case where an organic EL element is used, it should be understood that the present invention is by no means restricted to the organic EL element, but can be applied also to the driving of other display elements.

First Exemplary Embodiment

Figure 1:
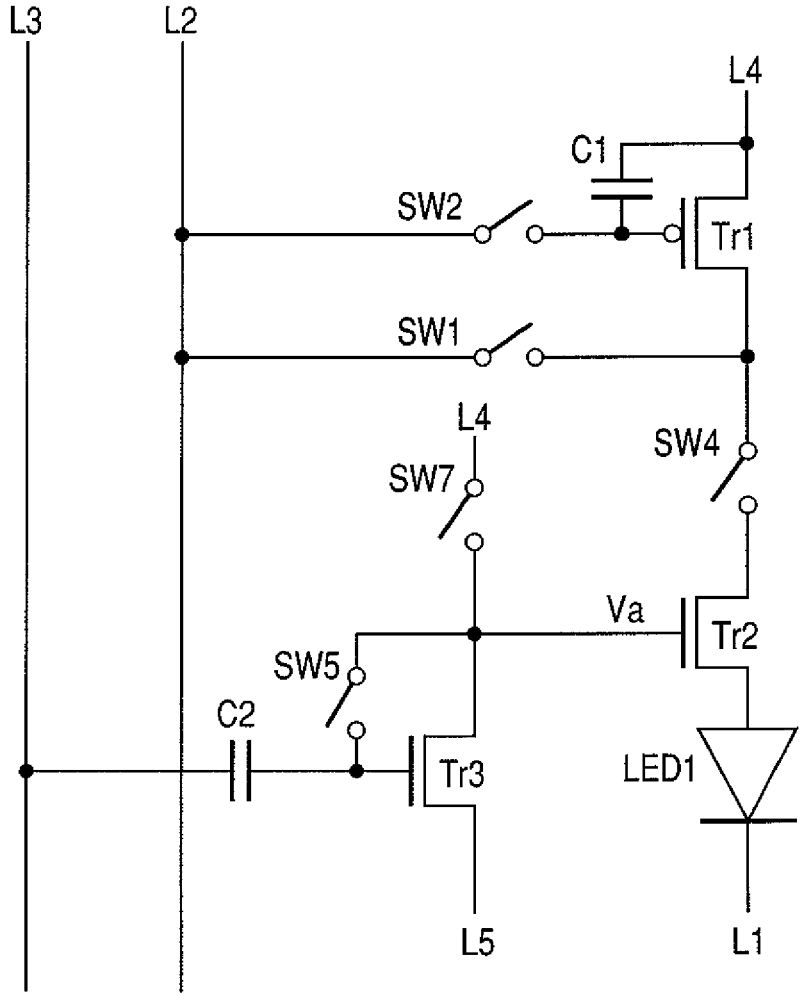
FIG. 1 is a circuit diagram illustrating a configuration of a first exemplary embodiment of the present invention.

A driving circuit according to the present exemplary embodiment will be described. With reference to FIG. 1, the device configuration will be described.

The driving circuit referred to here means a driving circuit for performing a driving control including a first period for setting a current to be supplied to a display element, a second period for setting a gray-scale of the display element, and a third period for supplying a driving current to the display element. The driving circuit according to the present invention comprises a current source circuit having a first transistor (Tr1) and a holding circuit (for example, C1) for holding a gate voltage of the first transistor during a first period at the voltage according to a constant current supplied to the display element (for example, LED1).

Further, the driving circuit comprises a second transistor (Tr2) for switching the current to the display element from the current source circuit.

The driving circuit further includes a third transistor (Tr3) whose one end of source or drain is connected to a gate of the second transistor and a capacitor element (C2) whose one end is connected to a gate of the third transistor and the other end is connected to a line (L3), and has a control circuit in which the light emission time of the display element is controlled by controlling the second transistor during the third period.

Here, during the second period, an electric charge is accumulated in the capacitor element (C2) based on the difference between a gray-scale voltage supplied from the line and a threshold value voltage of the third transistor is accumulated.

Next, during the third period, an ON voltage is applied to a control terminal of the second transistor (Tr2), and at the same time, a sweep voltage is applied to the capacitor element from the line, so that the ON time of the second transistor is controlled.

By such a configuration, when the display element is supplied with a constant current and driven, the supply period can be controlled.

By using a specific constituent comprising the driving circuit and a timing chart, the invention according to the present exemplary embodiment will be described below in detail. Incidentally, the gate of the above described transistor means a gate electrode.

The configuration of a first exemplary embodiment of the present invention is illustrated in FIG. 1. The present exemplary embodiment is provided with an organic EL element LED1 whose one end is connected to a first line L1, and a driving circuit for driving the organic EL element LED1. The driving circuit is configured as follows.

First, the driving circuit is provided with a p-type transistor Tr1, which is a first transistor whose source is connected to one end of a first capacitor C1 and a fourth line L4, and whose gate is connected to the other end of the first capacitor C1. Further, the driving circuit is provided with a first switch SW1 whose one end is connected to a drain of the first transistor and the other end is connected to a second line L2, and a second switch SW2 whose one end is connected to a gate of the first transistor Tr1 and the other end is connected to a line L2.

These first capacitor C1, first transistor Tr1, first switch SW1, and second switch SW2 configure a current source circuit.

Further, the driving circuit is provided with a fourth switch SW4 whose one end is connected to the drain of the first transistor Tr1. Further, the driving circuit is provided with an n-type transistor Tr2, which is a second transistor whose source is connected to one end of the side not connected to a line L1 of the organic EL element LED1 and whose drain is connected to the drain of the first transistor Tr1 through the fourth switch SW4.

Further, the driving circuit is provided with a second capacitor C2 whose one end is connected to a gate of a second transistor Tr2 through a fifth switch SW5 and the other end is connected to a third line L3. Further, the driving circuit is provided with an n-type transistor Tr3 which is a third transistor whose one end among the drain and source is connected to a fifth line L5.

The gate of the third transistor Tr3 is connected to one end each of the second capacitor C2 and the fifth switch SW5, and another end among the source and drain is connected to the gate of the second transistor Tr2 and another end of the switch SW5. Further, the driving circuit is provided with a seventh switch SW7 whose one end is connected to the gate of the second transistor Tr2 and the other end is connected to the line L4.

These second transistor Tr2, third transistor Tr3, second capacitor C2, switches SW4, SW5, and SW7 configure the control circuit for controlling the light emission time of the organic EL element LED1.

Figure 2:
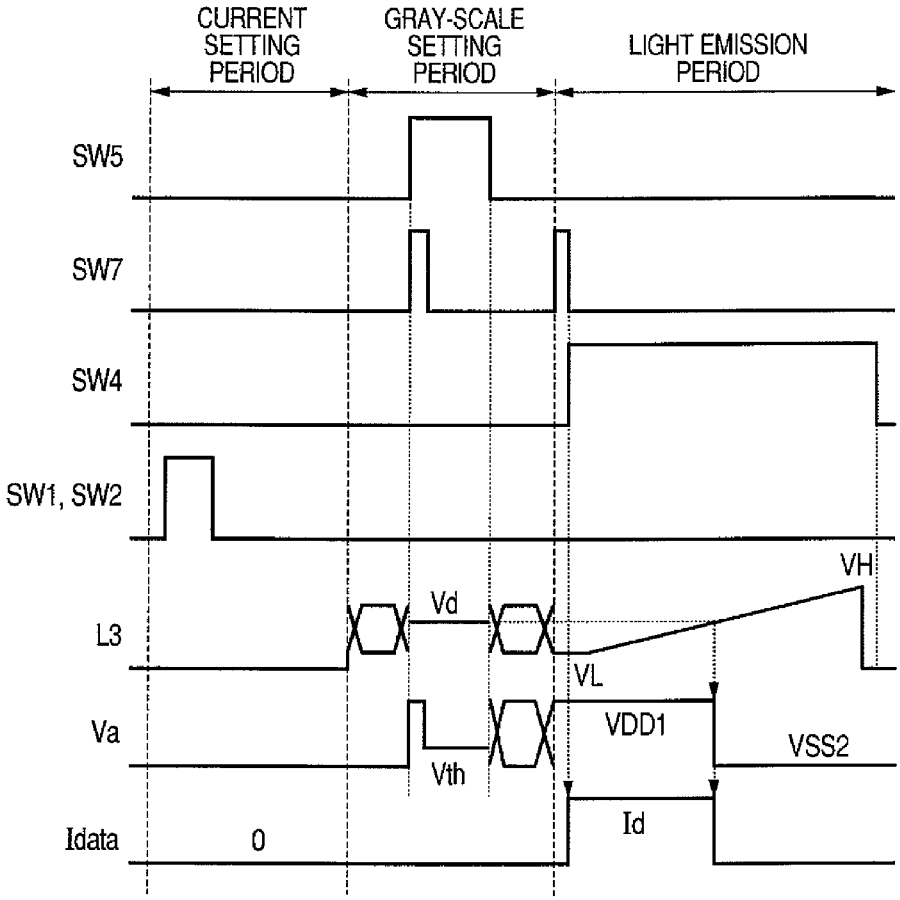
FIG. 2 is a timing chart illustrating an operation of the first exemplary embodiment.

A timing chart of the operation of the present exemplary embodiment is illustrated in FIG. 2. Incidentally, the lines L1, L4, and L5 are applied with constant voltages VSS1, VDD1, and VSS2, and the line L2 is supplied with a constant current Id. The gate voltage of the second transistor Tr2 shall be Va.

First, in the current setting period as illustrated in FIG. 2, the switches SW1 and SW2 are turned on, and the switches SW4, SW5, and SW7 are tuned off. At this time, the current Id from the line L2 is supplied to the first transistor Tr1, and in a stable state, the gate voltage of the first transistor Tr1 becomes a voltage at which the current Id is let flow. After that, to turn off the switches SW1 and SW2 along with the termination of the current setting period, a voltage to let flow the current Id is held at the gate of the first transistor Tr1 and the first capacitor C1.

Next, in the gray-scale setting period as illustrated in FIG. 2, first, the switches SW5 and SW7 are turned on. As a result, the voltage Va becomes a voltage close to the VDD1 from the line L4. However, since the switch SW4 is turned off, the current is not supplied to the organic EL element LED1, and the organic EL element LED1 does not emit a light. The switch SW7 stays turned off.

At this time, a gray-scale voltage Vd is applied to one end of the capacitor C2 from the line L3. At this time, the voltage Va becomes a threshold value voltage Vth of the third transistor Tr3. Consequently, the voltage Vd is applied to one end of the second capacitor C2, the voltage Vth is applied to the other end. At this time, provided that the capacitance value of the capacitor C2 is taken as C2, an electric charge $Q2=C2\times(Vd-Vth)$ is accumulated on the second capacitor C2. After that, when the fifth switch SW5 is turned off, the second capacitor C2 holds the electric charge Q2.

Next, as illustrated in FIG. 2, in the light emission period, first, the seventh switch SW7 is turned on. As a result, the voltage Va becomes the VDD1. Next, the switch SW7 is turned off, and after that, the switch SW4 is turned on. The line L3 is swept by the voltages in the range of VL to VH by taking an appropriate time. At this time, due to charge pump effect in which the second capacitor C2 holds the electric charge Q2, the gate voltage Vth of the third transistor Tr3 becomes not more than the voltage Vth in the range where the line L3 is not more than the Vd from VL.

At this time, since the voltage Va holds the VDD1 and the second transistor Tr2 is turned on, the organic EL element LED1 is supplied with the current Id, thereby emitting a light. In like manner, when the line L3 becomes equal to or greater than the Vd, the gate voltage of the third transistor Tr3 becomes equal to or greater than the Vth, and therefore, the Va voltage becomes the VSS2 of the line L5. At this time, since the second transistor Tr2 is turned off, the organic EL element LED1 is not supplied with the current, and does not emit a light.

In this manner, the sweep voltage is applied to the capacitor element so that the gate voltage value of the third transistor exceeds the threshold value voltage.

As a result of the above described operation, even when variation exits in the Vth which is the characteristic of the third transistor Tr3, the second transistor Tr2 can be controlled from ON to OFF according to the gray-scale voltage Vd value applied from the line L3 at the gray-scale setting time. Hence, a control of the period in which the organic EL element LED1 emits a light by the gray-scale voltage Vd value can be performed regardless of the variation of the transistor.

Further, a write current in the current setting period is made into a greater current, and moreover, the current value is made constant, and therefore, even when the current is a small current corresponding to a low gray-scale, a time of the current setting period needs not to be made long, and such current can be used for an image display apparatus of high definition and a large screen.

Further, since the organic EL element LED1 is driven by the constant current, a lowering of luminance due to deterioration of the voltage-light emission characteristic of the organic EL element LED1 can be addressed.

Further, since the embodiment is not configured in such a manner that the display element (organic EL element) is driven by using the comparator as described as the second technique in the column of the Description of Related Art, the embodiment is not affected by the noise and leak current of the comparator, and the current of the organic EL element does not vary.

These effects can be obtained similarly in all the embodiments described below.

Incidentally, if the voltage variation held in the first capacitor C1 due to leakage at the switch off time is small, the current setting period can be set every frame or every several frames. At this time, the gray-scale setting period and the light emission period can be made much longer.

Further, since the turning on of the switch SW4 in the gray-scale setting period allows the voltage of the operation time to be applied to the second transistor Tr2, the effect of a parasite capacitance can be reduced. In this case, however, in the gray-scale setting period, the current flows into the organic EL element LED1 and ends up causing a light emission. Nevertheless, when the light emission period at this gray-scale setting time is extremely short against the light emission period at a gray-scale display time, no problem is posed.

Further, in place of the switch SW4, even when the third switch SW3 is provided between the second transistor Tr2 and the organic EL element LED1, the same operation and function can be realized.

Figure 3:
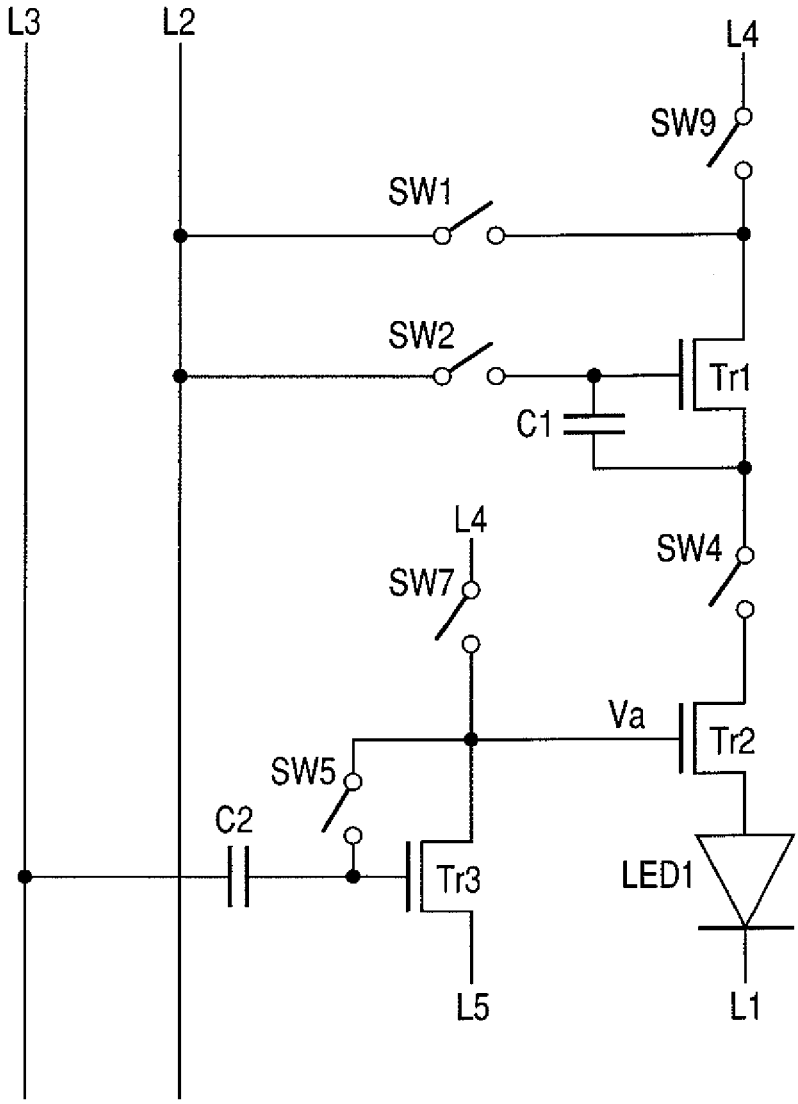
FIG. 3 is a circuit diagram illustrating an example where an n-type transistor is used as a first transistor Tr1 of the first exemplary embodiment.
Figure 4:
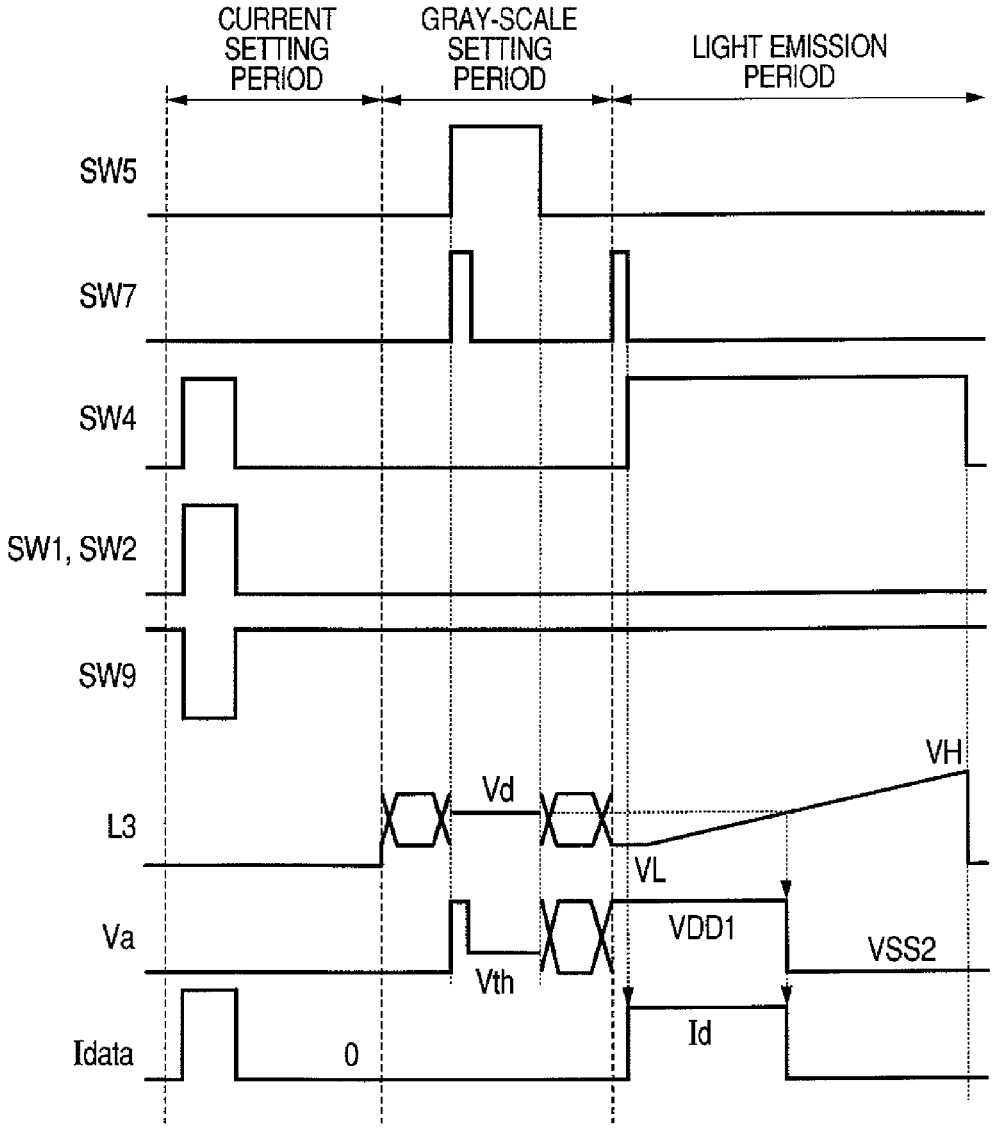
FIG. 4 is a timing chart illustrating the operation of FIG. 17.

Further, in place of the p-type transistor as the first transistor Tr1, the n-type transistor can be used. A circuit example in that case is illustrated in FIG. 3, and the timing chart is illustrated in FIG. 4. In FIG. 3, the same reference numerals are given to the same parts as FIG. 1.

In this case, the first transistor Tr1 is provided with the first capacitor C1 between the source and gate. Further, the first transistor Tr1 is provided with the first switch SW1 whose one end is connected to the drain of the first transistor Tr1 and the other end is connected to the second line L2 and the second switch SW2 whose one end is connected to the gate of the first transistor Tr1 and the other end is connected to the line L2. Further, the first transistor Tr1 is provided with a ninth switch SW9 whose one is connected to a fourth line L4 and the other end is connected to the drain of the first transistor Tr1.

In the present circuit, as illustrated in FIG. 4, the switch SW9 performs of inverse operation to the switches SW1 and SW2, and performs another movement similarly to the case of FIG. 1, so that the same function can be realized. However, as illustrated in FIG. 4, to secure a current channel in the current setting period, the switch SW4 is turned on, so that the current is let flow to the organic EL element LED1. When the light emission period at this current setting time is extremely short as against the light emitting time of the gray-scale display time, no problem is posed.

Figure 5:
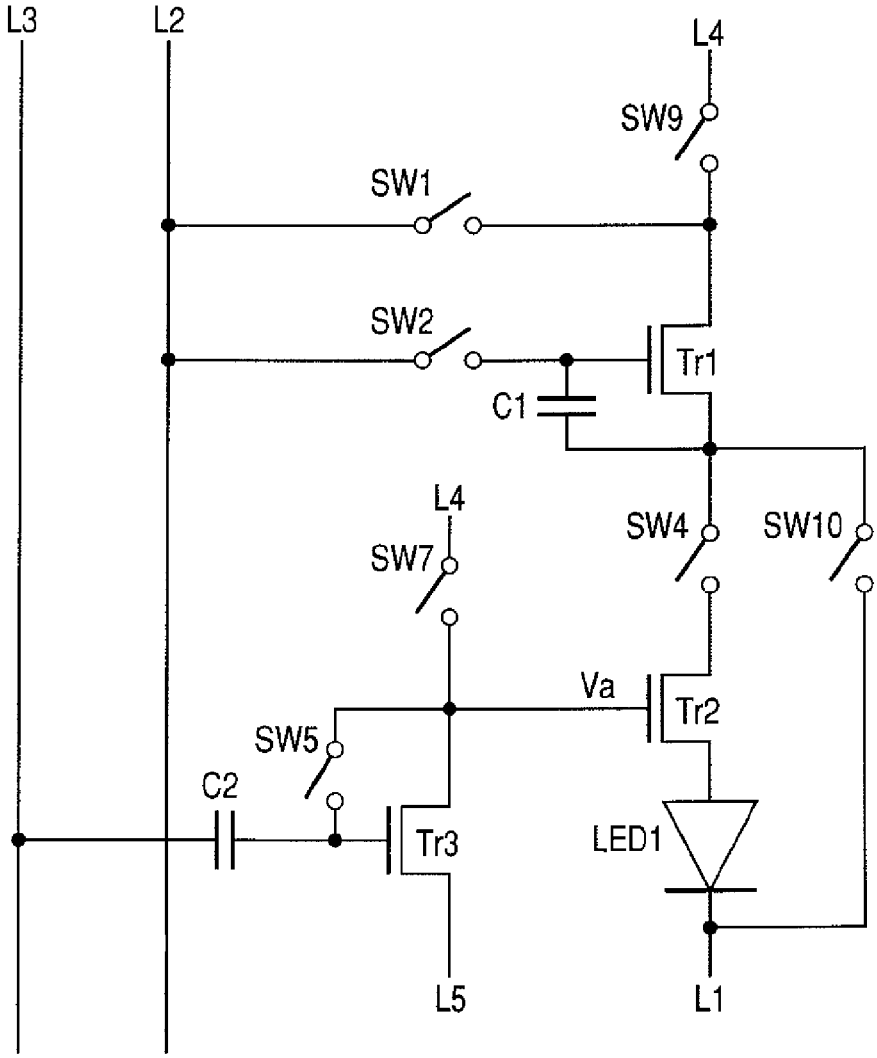
FIG. 5 is a circuit diagram illustrating an example where a switch SW10 is added in the first exemplary embodiment.

Further, as illustrated in FIG. 5, a switch SW10 which is a tenth switch whose one end is connected to the source of the first transistor Tr1 and one end of the switch SW4 and another end is connected to the line L1 (or the Line L5) may be provided. The difference with FIG. 3 is that the tenth switch SW10 is provided. The timing chart in that case is illustrated in FIG. 6.

Figure 6:
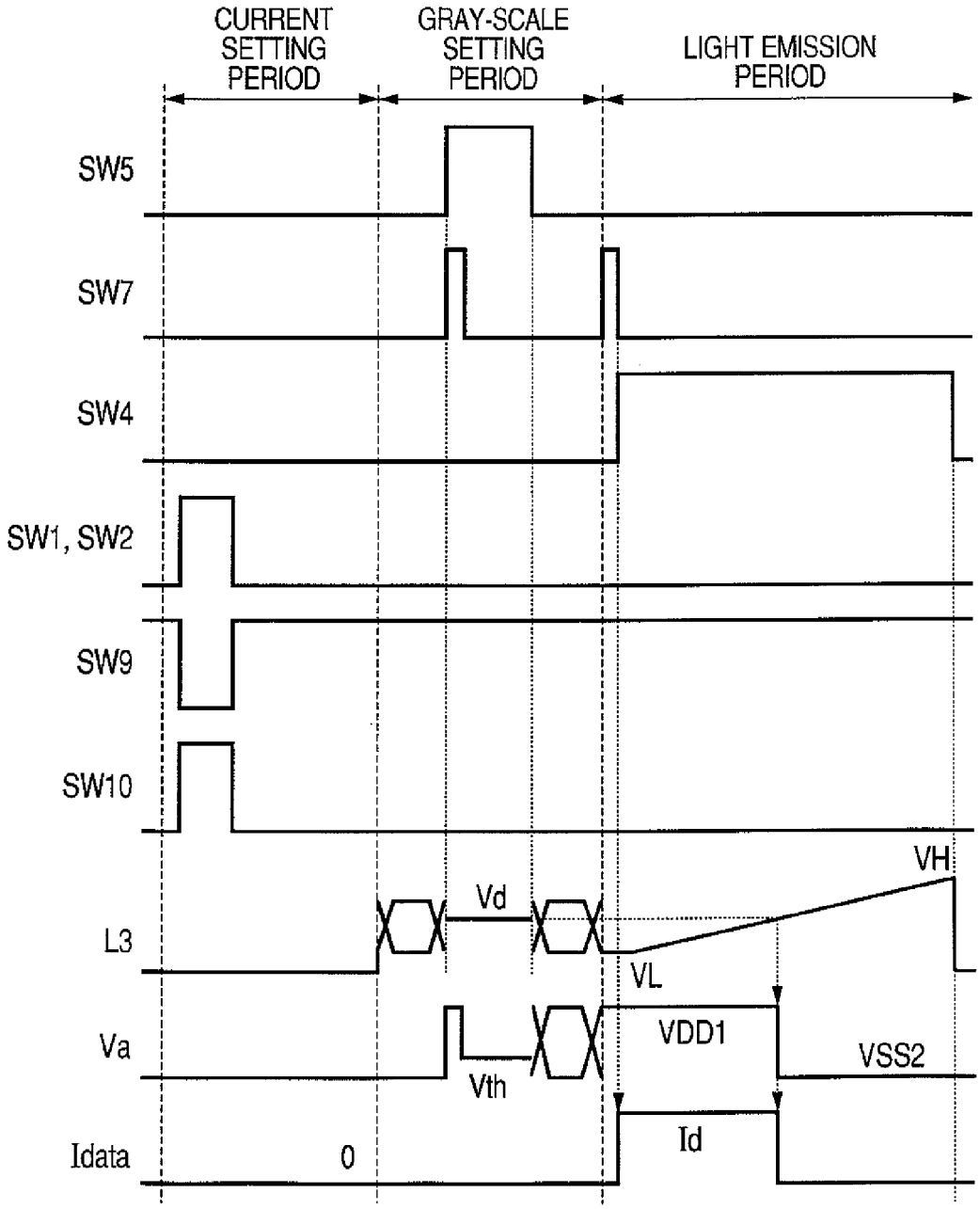
FIG. 6 is a timing chart illustrating the operation of FIG. 19.

First, as illustrated in FIG. 6, in the current setting period, the switch SW4 is turned off and the switch SW1 is turned on, so that a current channel different from the organic EL element LED1 is created. As a result, the light emission at the current setting time can be suppressed. The switch SW10 is always turned off except for the current setting period.

Further, even when the switch SW2 existing between the line L2 and the gate of the first transistor Tr1 is placed between the drain and gate of the first transistor Tr1, the same operation and function can be realized. This holds true for the case where the first transistor Tr1 is either the p-type or the n-type.

Further, similarly to the examples as illustrated in FIGS. 3 and 5, when the first transistor Tr1 is the n-type transistor, except for the current setting period, but at least in the light emission period, the line L2 is applied with the VDD1, and the switch SW1 is turned on. By so doing, the same function can be realized without using the line L4 and the switch SW9.

Further, for example, the switch SW6 is provided between the line L3 and the second capacitor C2, and the gray-scale voltage is held, so that the voltage Va can be held at the Vth. If designed such that when the Va is the Vth, the second transistor Tr2 is turned off, and when the Va is larger than the Vth, the second transistor Tr2 is turned on, a current channel to the organic EL element LED1 will be shut off by the second transistor Tr2 in place of the switch SW4. Hence, after setting the gray-scale voltage setting period, the current setting period is provided, so that the same function can be realized without having the switch SW4.

Figure 7:
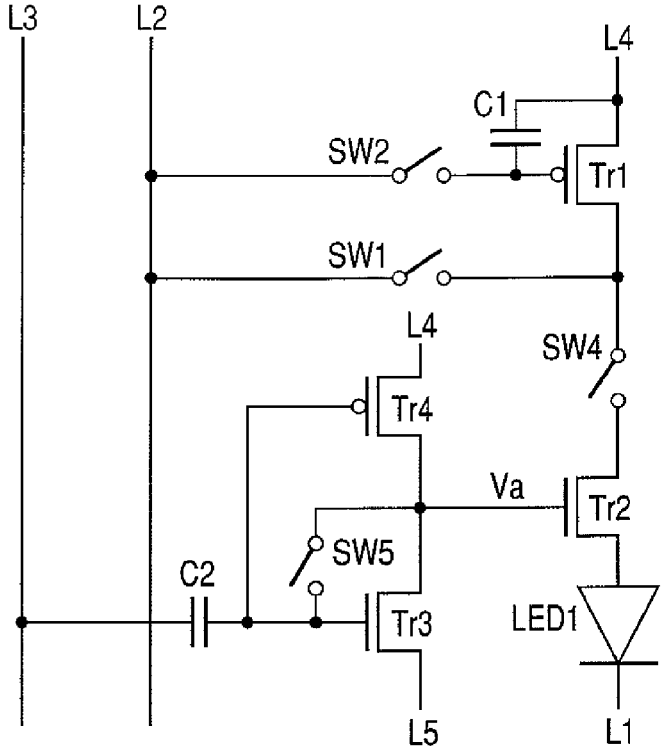
FIG. 7 is a circuit diagram illustrating an example where a transistor Tr4 is used in place of a switch SW7 in the first exemplary embodiment.
Figure 8:
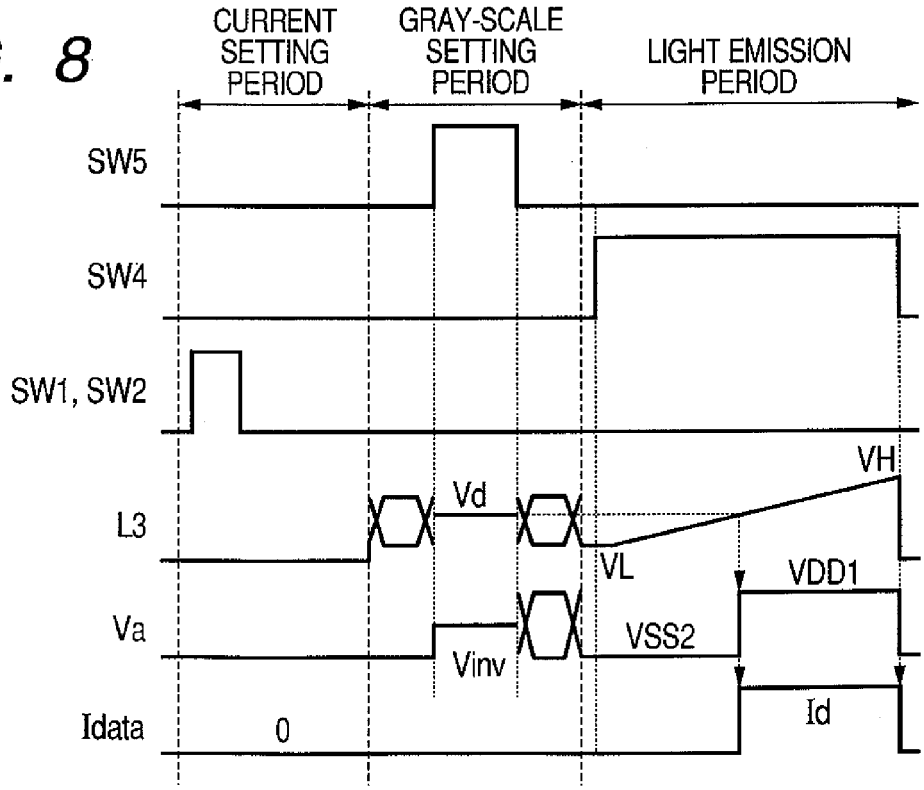
FIG. 8 is a timing chart illustrating the operation of FIG. 21.

Further, for example, as illustrated in FIG. 7, in place of the switch SW7, a fourth transistor Tr4 may be provided. That is, as a fourth transistor, a p-type transistor Tr4 is used, in which the source is connected to the line L4, and the drain is connected to the drain of the third transistor Tr3, and the gate is connected to the gate of the third transistor Tr3. The timing chart of that case is illustrated in FIG. 8. The difference with FIG. 1 is only in that the fourth transistor Tr4 is used in place of the switch SW7.

At this time, an inverter type comparator can be configured, in which variation of a logical inversion voltage (Vinv) of the inverter due to characteristic variations of the third and fourth transistors Tr3 and Tr4 is cancelled, by the third and fourth transistors Tr3 and Tr4, switch SW5, and second capacitor C2. Consequently, the same function can be realized. Here, it is desirable for the second transistor Tr2 to have a characteristic which comes to be in a sub threshold region equal to or less than a threshold value in the constant current to be supplied to the organic EL element LED1. In this case, the second transistor Tr2 is turned on or off by a slight change of the gate voltage of the second transistor Tr2, whereby it is possible to rapidly change whether or not to supply the current to the organic EL element LED1. Further, if an OFF current of the second transistor Tr2 is set to be equal to or less than 0.1% of the constant current, it does not influence the gray-scale control.

Incidentally, it is necessary to sufficiently increase the current ability of the second transistor Tr2 so that the second transistor Tr2 may be in the sub threshold region in the constant current. This can be achieved if the large-sized transistor is used, or if the transistor including a high-mobility semiconductor as the channel film is used.

Further, in the present invention a light emission display element including the above described organic EL element LED1 and its driving circuit on a substrate in a matrix pattern is disposed. The current setting period and gradating setting period are set up every line, and the line L3 is prepared every column to supply the gray-scale voltage, so that a matrix type light emission display element (image display apparatus) can be realized.

Incidentally, in the above description, while the organic electroluminescence element has been cited and illustrated as an example of the display element, the present invention is by no means limited thereto, and for example, an inorganic light emission element can be also applied.

Further, the above described transistors and switch elements can be configured by the thin film transistor (TFT). As the material of this TFT, while not particularly limited, for example, amorphous silicon, polycrystalline silicon, and monocrystal silicon can be applied for the channel film. Further, as the material of this channel film, an amorphous oxide semiconductor film comprising by including In and Zn can be also used. In particular, the TFT having the amorphous oxide semiconductor film as the channel film is desirable since whose mobility is high, whose OFF current is small, and this TFT can be manufactured easily.

Further, the electroconductive type of the transistors configuring the driving circuit according to the present exemplary embodiment may comprise either one only of the n-type or the p-type.

The above described driving circuit is provided in every pixel and is disposed in a matrix pattern, so that the image display apparatus can be also configured.

Incidentally, the examples of these display elements and the materials of the transistors as well as the electroconductive types can be applied in the invention according to the subsequent exemplary embodiments as far as they are consistent. Besides, as the light emission element, an organic electroluminescent element, an inorganic electroluminescent element, or an organic light emitting diode (OLED) can be used. This is also applicable even in the following exemplary embodiments.

Second Exemplary Embodiment

Hereinafter, the invention according to the present exemplary embodiment and component parts of the driving circuit thereof will be described by using FIG. 9.

Incidentally, the driving circuit referred to here means a driving circuit for performing a driving control including a first period for setting a current to be supplied to a display element, a second period for setting a gray-scale of the display element, and a third period for supplying a driving current to the display element.

Figure 9:
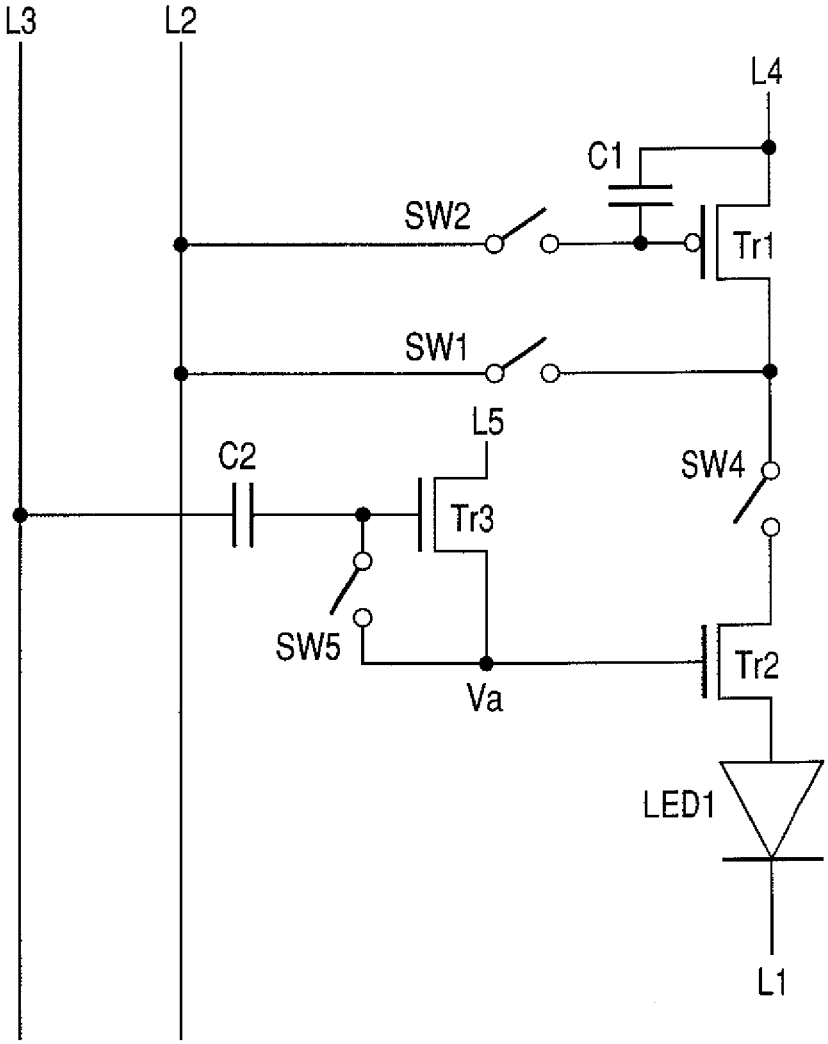
FIG. 9 is a circuit diagram illustrating the configuration of a second exemplary embodiment of the present invention.

As illustrated in FIG. 9, the driving circuit comprises a current source circuit having a first transistor (Tr1) and a holding circuit (e.g., C2) for holding a gate voltage of the first transistor during the first period at the voltage according to a constant current supplied to the display element (LED1).

Further, the driving circuit includes a second transistor (Tr2) for switching the current to the display element from the current source circuit, and a third transistor (Tr3) whose one end of a source or drain is connected to a gate of the second transistor, and a capacitor element (C2) whose one end is connected to a gate of the third transistor and whose another end is connected to a line (L3), and comprises a control circuit for controlling the light emission time of the display element by controlling the second transistor during the third period.

After a constant voltage is applied from the line during the second period, a gray-scale voltage is applied, and the capacitor element (C2) is accumulated with an electric charge based on the difference between the gray-scale voltage and a threshold value voltage of the third transistor.

The voltage to turn on the second transistor (Tr2) is applied to a gate of the second transistor through the third transistor (Tr3) during the third period, and after that, a sweep voltage is applied to the capacitor element from the line. In this manner, the ON time of the second transistor (Tr2) is controlled.

More specific description will be made below by using the timing chart of FIGS. 9 and 10.

The configuration of the second exemplary embodiment of the present invention will be illustrated in FIG. 9. The present exemplary embodiment is provided with an organic EL element LED1 whose one end is connected to a first line L1 and the driving circuit thereof. The driving circuit is configured as follows.

First, a P-type transistor Tr1 is provided, which is a first transistor whose source is connected to one end of a first capacitor C1 and a fourth line L4 and whose gate is connected to the other end of the first capacitor C1. Further, a first Switch SW1 whose one end is connected to the drain of the first transistor Tr1 and whose another end is connected to a second line L2, and a second switch SW2 whose one end is connected to the gate of the first transistor Tr1 and whose another end is connected to a line L2 are provided.

These first capacitor C1, first transistor Tr1, first switch SW1 and second switch SW2 configure the current source circuit.

Further, a fourth switch SW4 is provided, whose one end is connected to the drain of the first transistor Tr1. Further, an N-type transistor Tr2 is provided, which is a second transistor Tr2 whose source is connected to one end of the side not connected to a line L1 of the organic EL element LED1 and whose drain is connected to the drain of the first transistor Tr1 through the switch SW4.

Further, a second capacitor C2 is provided, whose one end is connected to the gate of the second transistor Tr2 through a switch SW5 and whose another end is connected to a third line L3. Further, an N-type transistor Tr3 is provided, which is a third transistor Tr3 whose one end inside the drain and source is connected to a fifth line L5.

The gate of the third transistor Tr3 is connected to one end of the second capacitor C2 and the switch SW5, and another end inside the source and drain is connected to the gate of the second transistor Tr2 and another end of the switch SW5.

These second and third transistors Tr2 and Tr3, second capacitor C2, and switches SW4 and SW5 configure a control circuit for controlling the light emission time of an organic EL element LED1.

Figure 10:
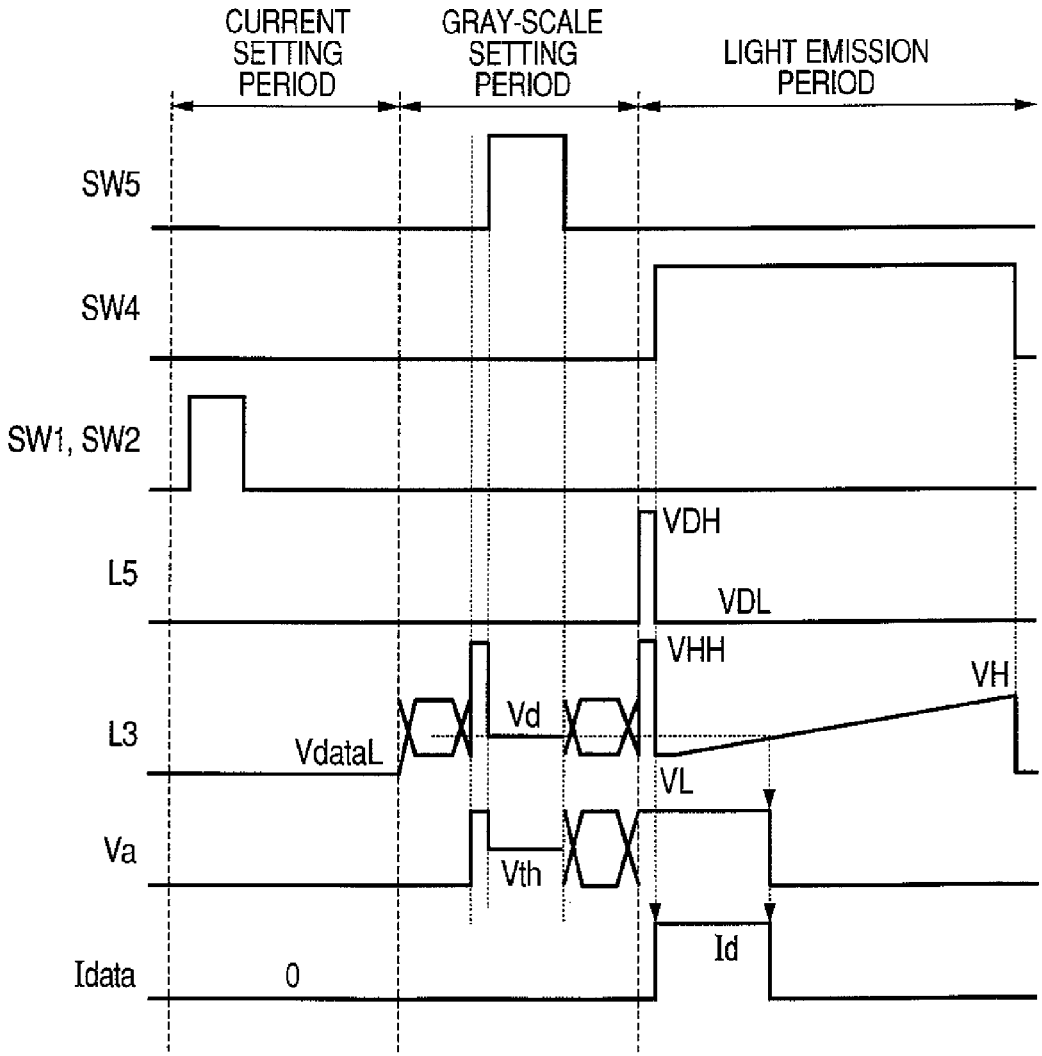
FIG. 10 is a timing chart illustrating the operation of the second exemplary embodiment.

The timing chart of the operation of the present exemplary embodiment will be illustrated in FIG. 10. However, the lines L1 and L4 are applied with constant voltages VSS1 and VDD1, and the line L2 is supplied with a constant current Id. The gate voltage of the second transistor Tr2 is taken as a Va.

First, as illustrated in FIG. 10, in the current setting period, the switches SW1 and SW2 are turned on, and the switches SW4 and SW5 are tuned off. The voltage of the line L5 is taken as a VDL. At this time, the first transistor Tr1 is supplied with a current Id from the line L2, and in a stable state, the gate voltage of the first transistor Tr1 becomes a voltage by which the current Id is let flow. After that, since the switches SW1 and SW2 are turned off along with the termination of the current setting period, a voltage to let flow the current Id is held in the gate of the first transistor Tr1 and the first capacitor C1.

Next, as illustrated in FIG. 10, in the gray-scale setting period, first, the voltage VHH is applied from the line L3. Here, the VHH makes the gate voltage of the third transistor Tr3 into a voltage capable of being set higher than the threshold value of the third transistor Tr3 by the charge pump effect. At this time, whatever voltage the voltage Va is, which is equivalent to the gate voltage of the second transistor Tr2, the switch SW is turned off, and therefore, the organic EL element LED1 is not supplied with the current, and does not emit a light. The switch SW5 is continuously turned on.

At this time, the gray-scale voltage Vd is applied from the line L3. At this time, the voltage Va becomes a threshold value voltage Vth since the gate and drain of the third transistor Tr3 are short-circuited. Consequently, one end of the second capacitor C2 is applied with the voltage Vd, and the other end is applied with the voltage Vth. At this time, the second capacitor C2, provided that the capacitance value of the capacitor C2 is taken as C2, is accumulated with an electric charge $Q2=C2\times(Vd-Vth)$. After that, when the switch SW5 is turned off, the second capacitor C2 holds the electric charge Q2.

Next, as illustrated in FIG. 10, in the light emission period, first, the line L3 is set to the VHH, and the line L5 is set to a VDH. Here, the VDH, due to the charge pump effect in which the second capacitor C2 holds the electric charge Q2, is taken as a voltage capable of raising the voltage Va higher than the Vth to the extent of several voltages.

Subsequently, after setting the line L5 to a VDL, the switch SW4 is turned on, and the line L3 sweeps the voltages in the range of a VL to a VH by taking an appropriate time. However, the VDL, when applied to the gate of the second transistor Tr2, is taken as a voltage in which the second transistor Tr2 is put into an off state.

Due to the charge pump effect, in the range where the line L3 is not more than the Vd from the VL, the gate voltage of the third transistor Tr3 becomes not more than the Vth. At this time, the voltage Va holds a voltage that is several voltages higher than the Vth, and since the second transistor Tr2 is turned on, the organic EL element LED1 is supplied with the current Id, and emits a light.

In like manner, when the line L3 becomes not less than the Vd, the gate voltage of the third transistor Tr3 becomes not less than the Vth, and therefore, the voltage Va becomes the VDL. At this time, since the second transistor Tr2 is tuned off by the VDL, the organic EL element LED1 is not supplied with the current nor does it emit a light.

As a result of the above described operation, even when variation exits in the Vth which is the characteristic of the third transistor Tr3, the second transistor Tr2 can be controlled from ON to OFF according to the gray-scale voltage Vd value applied from the line L3 at the gray-scale setting time. Hence, a control of the period in which the organic EL element LED1 emits a light by the Vd value can be performed without depending on the variation of the transistor.

Further, if the voltage variation held in the first capacitor C1 due to leakage at the switch off time is small, the current setting period can be set every frame or every several frames. At this time, the gray-scale setting period and the light emission period can be made much longer.

Further, since the turning on of the switch SW4 in the gray-scale setting period allows the voltage of the operation time to be applied to the second transistor Tr2, the effect of a parasite capacitance can be reduced. In this case, however, in the gray-scale setting period, the current flows into the organic EL element LED1 and ends up causing a light emission. Nevertheless, when the light emission period at this gray-scale setting time is extremely short as against the light emission period at a gray-scale display time, no problem is posed.

Further, in place of the switch SW4, even when the third switch SW3 is provided between the second transistor Tr2 and the organic EL element LED1, the same operation and function can be realized.

Further, similarly to the first exemplary embodiment, as the first transistor Tr1, an N-type transistor can be used in place of a P-type transistor. In that case, as described above, the transistor Tr1 and its periphery may be configured similarly to FIGS. 3 and 5.

Further, even if the switch SW2 existing between the line L2 and the first transistor Tr1 is disposed between the drain and gate of the first transistor Tr1, the same operation and function can be realized. This holds true also for the case where the first transistor Tr1 is the P-type or the N-type.

Further, as described above, when the first transistor Tr1 is the N-type transistor, except for the current setting period, but at least in the light emission period, the line L2 is applied with the VDD1, and the switch SW1 is turned on. By so doing, the same function can be realized without using the line L4 and the switch SW9.

Further, for example, the switch SW6 is provided between the line L3 and the second capacitor C2, and the gray-scale voltage is held, so that the voltage Va can be held in the Vth. When a design is made such that the second transistor Tr2 is turned off when the Va is the Vth, and the second transistor is turned off when the Va is larger than the Vth, a current channel to the organic EL element LED1 is shut off by the second transistor Tr2 in place of the switch SW4. Hence, after setting the gray-scale voltage setting period, the current setting period is provided, so that the same function can be realized without having the switch SW4. Here, it is desirable for the second transistor Tr2 to have a characteristic which comes to be in a sub threshold region equal to or less than a threshold value in the constant current to be supplied to the organic EL element LED1. In this case, the second transistor Tr2 is turned on or off by a slight change of the gate voltage of the second transistor Tr2, whereby it is possible to rapidly change whether or not to supply the current to the organic EL element LED1. Further, if an OFF current of the second transistor Tr2 is set to be equal to or less than 0.1% of the constant current, it does not influence the gray-scale control.

Incidentally, it is necessary to sufficiently increase the current ability of the second transistor Tr2 so that the second transistor Tr2 may be in the sub threshold region in the constant current. This can be achieved if the large-sized transistor is used, or if the transistor including a high-mobility semiconductor as the channel film is used.

Further, the present invention disposes a light emission display element including the above described organic EL element LED1 and its driving circuit on a substrate in a matrix pattern. The current setting period and gradating setting period are set up every line, and the line L3 is prepared every column so as to supply the gray-scale voltage, thereby a matrix type light emission display element (image display apparatus) can be realized.

Third Exemplary Embodiment

By using FIG. 11, the invention according to the present exemplary embodiment and the driving circuit thereof will be described.

The driving circuit referred to here means a driving circuit of a display element including a first period for setting a current to be supplied to a display element, a second period for setting a gray-scale of the display element, and a third period for supplying a driving current to the display element.

Figure 11:
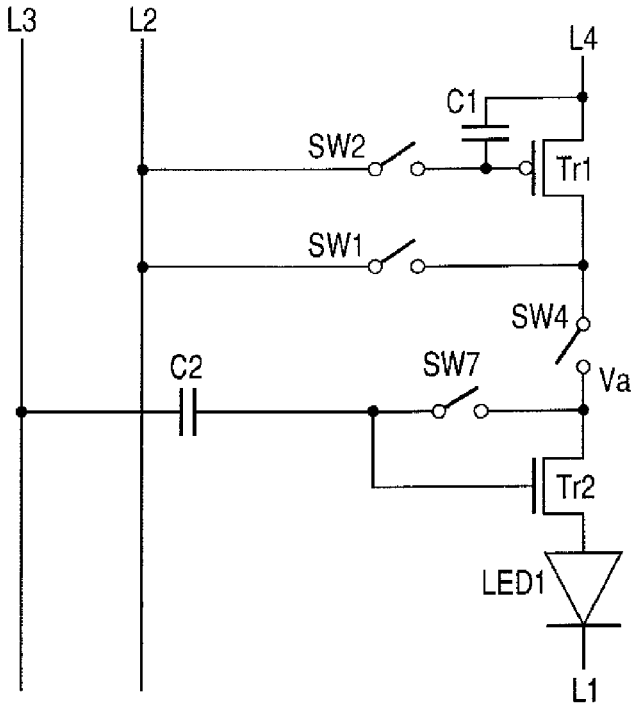
FIG. 11 is a circuit diagram illustrating the configuration of a third exemplary embodiment of the present invention.

As illustrated in FIG. 11, the driving circuit comprises a current source circuit having a first transistor (Tr1) and a holding circuit (for example, C1) for holding a gate voltage of the first transistor during the first period at a voltage according to a constant current supplied to the display element (LED1).

Further, the driving circuit includes a second transistor (Tr2) connected in series to the first transistor (Tr1) and a capacitor element (C2) whose one end is connected to a gate of the second transistor and whose another end is connected to a line (L3), and comprises a control circuit for controlling the light emission time of the display element by controlling the second transistor during the third period.

An electric charge based on the difference between the gray-scale voltage supplied from the line to the capacitor element (C2) during the second period and a gate of the second transistor is accumulated.

A sweep voltage is applied from the line L3 to the capacitor element (C2) during the third period, so that the ON time of the second transistor is controlled.

Hereinafter, by using FIG. 11 and a timing chart (FIG. 12), the invention according to the present exemplary embodiment will be described in detail.

A configuration of the third exemplary embodiment of the present invention will be illustrated in FIG. 11. The present exemplary embodiment comprises an organic EL element LED1 whose one end is connected to a first line L1 and its driving circuit. The driving circuit is configured as follows.

First, a P-type transistor Tr1 is provided, which is a first transistor whose source is connected to one end of a first capacitor C1 and whose gate is connected to the other end of the first capacitor C1. Further, a first Switch SW1 whose one end is connected to the drain of the first transistor Tr1 and whose another end is connected to a second line L2, and a second switch SW2 whose one end is connected to the gate of the first transistor Tr1 and another end is connected to a line L2 are provided.

These first transistor Tr1, first capacitor C1, first and second switches SW1 and SW2 configure the current source circuit.

Further, a fourth switch SW4 is provided, whose one end is connected to the drain of the first transistor Tr1. Further, an N-type transistor Tr2 is provided, which is a second transistor Tr2 whose source is connected to one end of the side not connected to a line L1 of the organic EL element LED1 and whose drain is connected to the drain of the first transistor through the switch SW4.

Further, a second capacitor C2 is provided, whose one end is connected to the gate of the second transistor Tr2 and whose another end is connected to a third line L3. Further, a seventh switch SW7 is provided, whose one end is connected to the gate of the second transistor Tr2 and whose another end is connected to the drain of the second transistor Tr2. These second transistor Tr2, second capacitor C2, and switches SW4 and SW7 configure a control circuit for controlling the light emission time of the organic EL element LED1.

Figure 12:
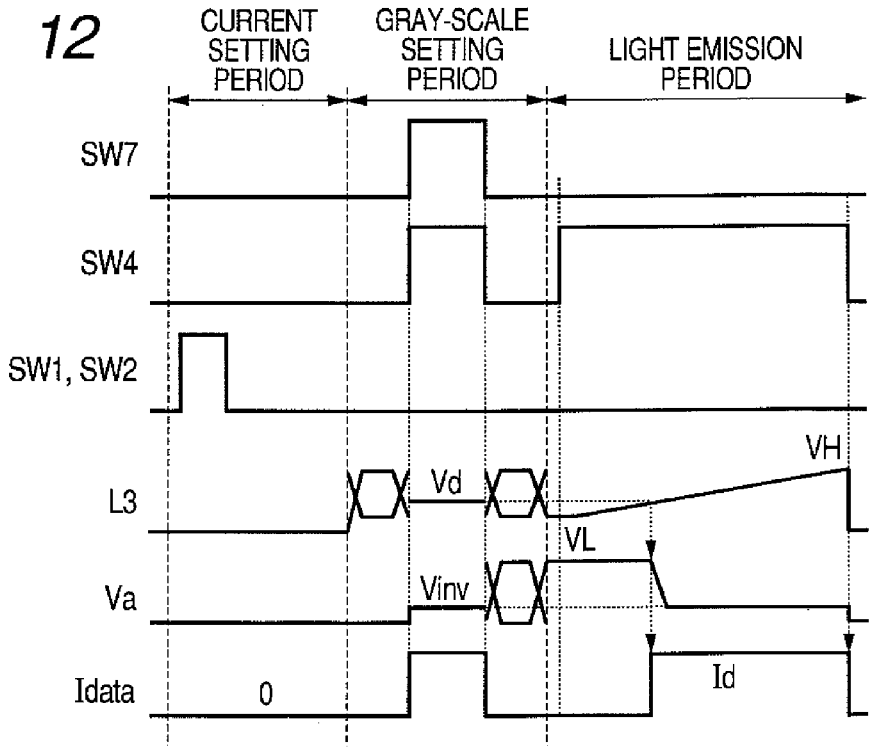
FIG. 12 is a timing chart illustrating the operation of a third exemplary embodiment.

A timing chart of the operation of the present exemplary embodiment will be illustrated in FIG. 12. However, the lines L1 and L4 are applied with constant voltages VSS1 and VDD1, and the line L2 is supplied with a constant voltage Id. The drain voltage of the second transistor Tr2 is taken as a Va.

First, as illustrated in FIG. 12, in the current setting period, the switches SW1 and SW2 are turned on, and the switches SW4 and SW7 are tuned off. At this time, the first transistor Tr1 is supplied with a current Id from the line L2, and in a stable state, the gate voltage of the first transistor Tr1 becomes a voltage into which the current Id is let flow. After that, as illustrated in FIG. 12, since the switches SW1 and SW2 are turned off along with the termination of the current setting period, a voltage to let flow the current Id is held in the gate of the first transistor Tr1 and the first capacitor C1.

Next, as illustrated in FIG. 12, in the gray-scale setting period, the switches SW4 and SW7 are turned on, and the gray-scale voltage Vd is applied form the line L3. At this time, since the switch SW4 is turned on, the current Id is supplied to the second transistor Tr2 and the organic EL element LED1 from the first transistor Tr1. Further, since the switch SW7 is turned on, the gate and drain of the second transistor Tr2 are short-circuited, and the second transistor Tr2 allows the current Id to flow.

Consequently, the Va and the gate voltage of the second transistor Tr2 become a voltage Vinv into which the current Id is let flow. Hence, one end of the second capacitor C2 is applied with a voltage Vd, and another end is applied with a voltage Vinv. At this time, the second capacitor C2, provided that a capacitance value of the capacitor C2 is taken as C2, is accumulated with an electric charge $Q2=C2\times(Vd-Vinv)$. After that, when the fifth switches SW5 and SW7 are turned off, the second capacitor C2 holds the electric charge Q2.

Next, as illustrated in FIG. 12, in the light emission period, the switch SW4 is turned on, and the line L3 sweeps the voltages in the range of a VL to a VH by taking an appropriate time. At this time, due to a charge pump effect in which the second capacitor C2 holds the electric charge Q2, the gate voltage of the second transistor Tr2 becomes not more than the Vinv in the range where the line L3 is not more than the Vd from the VL.

At this time, though the voltage Va becomes greater than the Vinv, since a voltage drop at the second transistor Tr2 is great, the voltages at the source of the second transistor Tr2 and one end of the organic EL element LED1 are low. Consequently, the organic EL element LED1 is not supplied with the inflow current nor does it emit a light. When the line L3 becomes not less than the Vd, the gate voltage of the second transistor Tr2 becomes not less than the Vinv. At this time, the voltage Va becomes the Vinv, and the organic EL element LED1 is supplied with the inflow current Id, and emits a light.

As a result of the above described operation, even when variation exits in the Vinv which is the characteristic of the second transistor Tr2, the second transistor Tr2 can be controlled from a state not letting flow the current Id to the organic EL element LED1 to a state letting flow the current Id according to the gray-scale volt according to the gray-scale voltage Vd applied from the line L3 at the gray-scale setting time. Hence, a control of the period in which the organic EL element LED1 emits a light by the Vd value can be performed without depending on the variation of the transistor.

Further, if variation of the voltage held in the first capacitor C1 due to leakage at the switch off time is small, the current setting period can be provided every frame or several frames. At this time, the gray-scale setting period and the light emission period can be made much longer.

Further, in place of the switch SW4, even when the third switch SW3 is provided between the second transistor Tr2 and the organic EL element LED1, the same operation and function can be realized.

Further, similarly to the first exemplary embodiment, as the first transistor Tr1, the N-type transistor in place of the P-type transistor can be used. In that case, as described above, the transistor Tr1 and its periphery may be configured similarly to FIGS. 3 and 5.

Further, even when the switch SW2 existing between the line L2 and the gate of the first transistor Tr1 is placed between the drain and gate of the first transistor Tr1, the same operation and function can be realized. This holds true for the case where the first transistor Tr1 is either the P-type or the N-type.

Further, when the first transistor Tr1 is the N-type transistor, except for the current setting period, but at least in the light emission period, the line L2 is applied with the VDD1, and the switch SW1 is turned on. By so doing, the same function can be realized without using the line L4 and the switch SW9.

Figure 13:
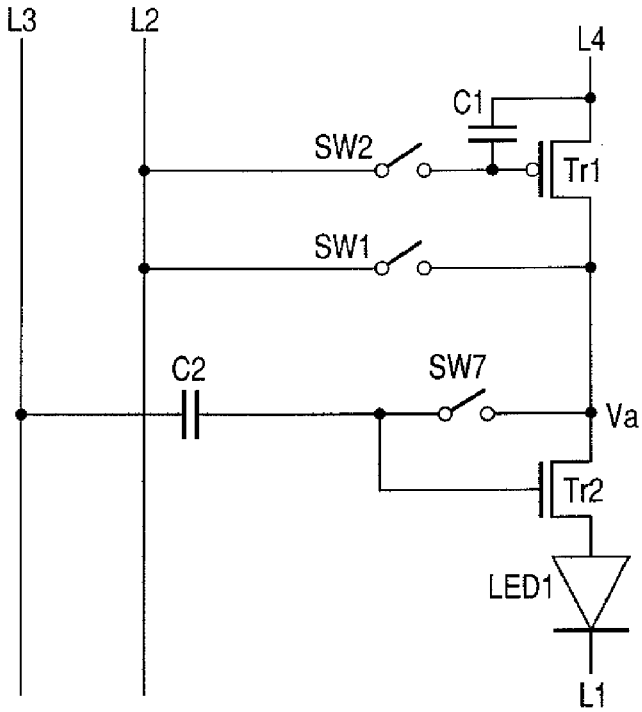
FIG. 13 is a circuit diagram illustrating an example where a switch SW4 is deleted in the third exemplary embodiment.
Figure 14:
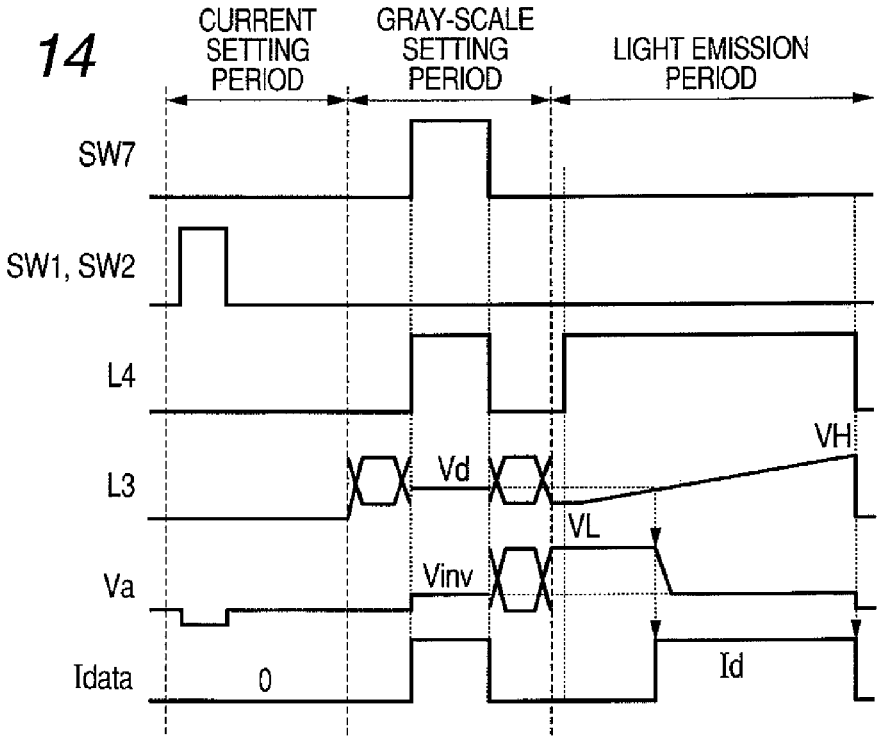
FIG. 14 is a timing chart illustrating the operation of FIG. 27.

Further, by fluctuating the voltage of the line L4, the switch SW4 can be cut back. The configuration in that case will be illustrated in FIG. 13, and its timing chart in FIG. 14. In this case, as illustrated in FIG. 14, the voltage of the line L4 is taken as the VDD1 in the gray-scale setting period and the light emission period, and is taken as the VSS1 in other periods including the current setting period. In the current setting period, when the voltage of the line L2 is set not more than the VSS1 in order to let flow the current Id to the line L2, the voltage Va becomes not more than the VSS1.

Hence, the organic EL element LED1 is applied with the VSS1 at the cathode, and a minus bias which is not more than the VSS1 at the anode, and the current is not supplied to the organic EL element LED1. To accurately perform a current setting operation, it is necessary to allow the current Id to flow only into the first transistor Tr1 without flowing into other current channels.

In the present configuration, since the organic EL element LED1 is not supplied with the current, a current setting of the first transistor Tr1 is easily accomplished. After that, in the gray-scale setting period and the light emission period, the operation as described above is performed.

Incidentally, while the sameness as the present configuration and operation is applicable to the first and second exemplary embodiments as well as all the embodiments described below, since the present exemplary embodiment is configured to have the least number of elements, and moreover, can reduce the switches, it is most effective to apply the same to the present exemplary embodiment. Here, it is desirable for the second transistor Tr2 to have a characteristic which comes to be in a sub threshold region equal to or less than a threshold value in the constant current to be supplied to the organic EL element LED1. In this case, the second transistor Tr2 is turned on or off by a slight change of the gate voltage of the second transistor Tr2, whereby it is possible to rapidly change whether or not to supply the current to the organic EL element LED1. Further, if an OFF current of the second transistor Tr2 is set to be equal to or less than 0.1% of the constant current, it does not influence the gray-scale control.

Incidentally, it is necessary to sufficiently increase the current ability of the second transistor Tr2 so that the second transistor Tr2 may be in the sub threshold region in the constant current. This can be achieved if the large-sized transistor is used, or if the transistor including a high-mobility semiconductor as the channel film is used.

Further, in the present exemplary embodiment as described above, the current flows in the organic EL element LED1 during the gray-scale setting period, whereby the organic EL element LED1 emits a light. A problem can be prevented from occurring in the displaying by sufficiently shortening this gray-scale setting period as compared with the whole light emission period.

Here, a line L5 to which the voltage same as that applied to the line L1 or equal to or less than the operation voltage of the organic EL element LED1 is applied is provided, and a switch SW8 is provided between the source of the second transistor Tr2 and the line L5. Then, the switch SW8 is turned on only during the gray-scale setting period, and the switch SW8 is turned off during other periods, whereby it is possible to suppress the light emission of the organic EL element LED1 during the gray-scale setting period, and it is thus possible to further increase a contrast.

Further, the present invention disposes the organic EL element LED1 such as described above and the light emission display element including the driving circuit on a substrate in a matrix pattern. The current setting period and gray-scale setting period are performed every line, and the line L3 is prepared every column to supply the gray-scale voltage, so that a matrix type light emission display element (image forming apparatus) can be realized.

Fourth Exemplary Embodiment

By using FIG. 15, the components of a driving circuit according to the present exemplary embodiment will be described.

The driving circuit referred to here means a driving circuit having a first period for setting a current to be supplied to a display element, a second period for setting a gray-scale of the display element, and a third period for supplying a driving current to the display element.

Figure 15:
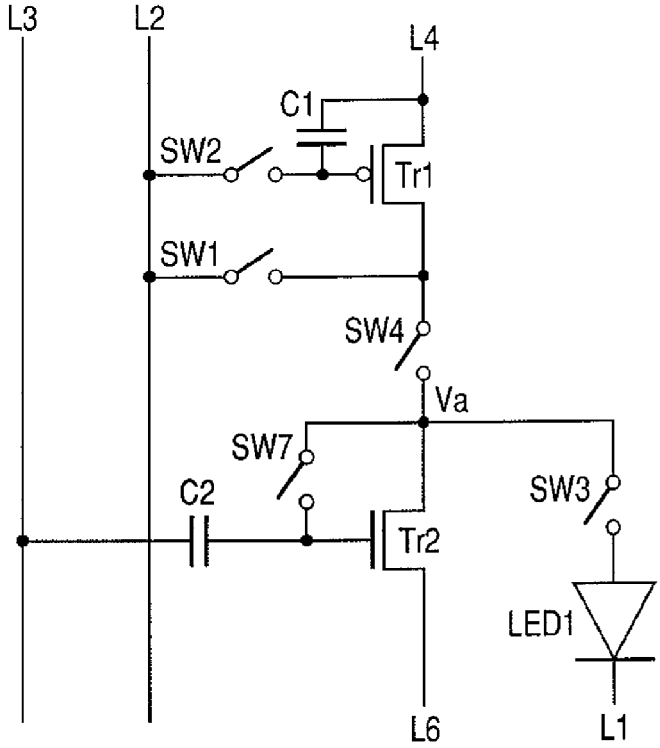
FIG. 15 is a circuit diagram illustrating the configuration of a fourth exemplary embodiment of the present invention.

As illustrated in FIG. 15, the driving circuit comprises a current source circuit having a first transistor (Tr1) and a holding circuit (For example, C1) for holding a gate voltage of the first transistor during the first period at a voltage according to a constant current supplied to the display element.

Further, the driving circuit includes a second transistor (Tr2) connected in series to the current source circuit and connected in parallel to the display element (LED1), and a capacitor element (C2) whose one end is connected to a gate of the second transistor and whose another end is connected to a line (L3), and comprises a control circuit for controlling the light emission time of the display element by controlling the second transistor during the third period.

During the first period, a constant voltage is applied from the line (L3).

Further, during the second period, a gray-scale voltage is applied from the line, and moreover, the gate of the second transistor and the other terminal are short-circuited, and the capacitor elements accumulated with an electric charge based on the difference between the gray-scale voltage and a gate voltage of the second transistor Tr2.

Further, during the third period, a sweep voltage is applied from the line (L3), so that the ON time of the second transistor is controlled.

Hereinafter, by using FIG. 15 and a timing chart (FIG. 16), the fourth exemplary embodiment will be described more in detail.

A configuration of the fourth exemplary embodiment of the present invention will be illustrated in FIG. 15. The present exemplary embodiment is provided with an organic EL element LED1 whose one end is connected to a first line L1, and its driving circuit. The driving circuit is configured as follows.

First, a P-type transistor Tr1 is provided, which is a first transistor whose source is connected to one end of a first capacitor C1 and whose gate is connected to the other end of the first capacitor C1. Further, a first Switch SW1 whose one end is connected to the drain of the first transistor Tr1 and whose another end is connected to a second line L2, and a second switch SW2 whose one end is connected to the gate of the first transistor Tr1 and whose another end is connected to a line L2 are provided.

These first transistor Tr1, first capacitor C1, first and second switches SW1 and SW2 configure the current source circuit.

Further, a fourth switch SW4 whose one end is connected to the drain of the first transistor Tr1, and a third switch SW3 whose one end is connected to one end of the side not connected to the line L1 of the organic EL element LED1 are provided.

Further, an N-type transistor Tr2, which is a second transistor whose source is connected to a sixth line L6 and whose drain is connected to one end of the side not connected to the drain of the first transistor Tr1 of the switch SW4 is provided.

Further, a second capacitor C2 is provided, whose one end is connected to the gate of the second transistor Tr2 and whose another end is connected to a third line L3. Further, a seventh switch SW7 is provided, whose one end is connected to the gate of the second transistor Tr2 and whose another end is connected to the drain of the second transistor Tr2.

These second transistor Tr2, second capacitor C2, and third SW3, fourth switch SW4, and seventh switch SW7 configure a control circuit for controlling the light emission time of the organic EL element LED1.

Figure 16:
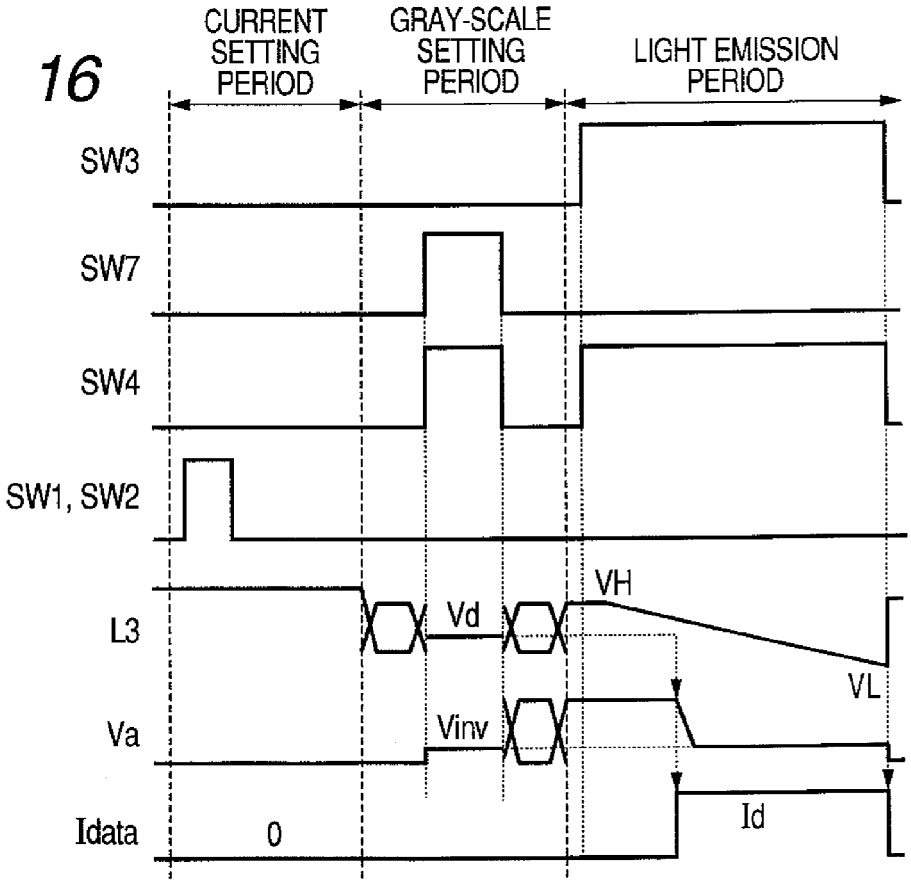
FIG. 16 is a timing chart illustrating the operation of the fourth exemplary embodiment.

A timing chart of the operation of the present exemplary embodiment will be illustrated in FIG. 16. However, the lines L1, L4 and L6 are applied with constant voltages VSS1, VDD1, and VSS2 not more than the VSS1, and the line L2 is supplied with a constant voltage Id. Further, the drain voltage of the second transistor Tr2 is taken as a Va.

First, as illustrated in FIG. 16, in the current setting period, the switches SW1 and SW2 are turned on, and the switches SW3, SW4, and SW7 are tuned off. The voltage of the line L3 is taken as a VH or a voltage greater than the VH. At this time, the first transistor Tr1 is supplied with a current Id from the line L2, and in a stable state, the gate voltage of the first transistor Tr1 becomes a voltage by which the current Id is let flow. After that, since the switches SW1 and SW2 are turned off along with the termination of the current setting period, a voltage to let flow the current Id is held in the gate of the first transistor Tr1 and the first capacitor C1.

Next, as illustrated in FIG. 16, in the gray-scale setting period, the switches SW4 and SW7 are turned on, and the gray-scale voltage Vd is applied from the line L3. At this time, since the switch SW4 is turned on, the current Id is supplied to the second transistor Tr2 from the first transistor Tr1. Further, since the switch SW7 is turned on, the gate and drain of the second transistor Tr2 are short-circuited, and the second transistor Tr2 allows the current Id to flow.

Consequently, the Va and the gate voltage of the second transistor Tr2 become a voltage Vinv by which the current Id is let flow. Hence, one end of the second capacitor C2 is applied with a voltage Vd, and another end is applied with a voltage Vinv. At this time, the second capacitor C2, provided that a capacitance value of the capacitor C2 is taken as C2, is accumulated with an electric charge $Q2=C2\times(Vd-Vinv)$. After that, when the switches SW4 and SW7 are turned off, the second capacitor C2 holds the electric charge Q2.

Next, as illustrated in FIG. 16, in the light emission period, the switch SW4 is turned on, and the line L3 sweeps the voltages in the range of a VH to a VL by taking an appropriate time. At this time, due to the charge pump effect in which the second capacitor C2 holds the electric charge Q2, the gate voltage of the second transistor Tr2 becomes not less than the voltage Vinv in the range where the line L3 is the Vd from the VH.

At this time, the voltage VSS2 of the line L6 is set not more than the VSS1, so that the voltage Va can drop the voltages of the source of the second transistor Tr2 and one end of the organic EL element LED1 to such an extent that the current Id is not supplied to the organic EL element LED1, thereby the organic EL element LED1 does not emit a light.

On the other hand, when the line L3 becomes less than the voltage Vd, the gate voltage of the second transistor Tr2 becomes not more than the Vinv. At this time, since the second transistor Tr2 becomes highly resistive, the current does not flow into the second transistor Tr2, so that the organic EL element LED1 is supplied with the current Id, and emits a light.

As a result of the above described operation, even when variation exits in the Vinv which is the characteristic of the second transistor Tr2, the second transistor Tr2 can be controlled from a state of not letting flow the current Id to a state of letting flow the current Id to the organic EL element LED1 according to the gray-scale voltage Vd applied from the line L3 at the gray-scale setting time. Hence, a control of the period in which the organic EL element LED1 emits a light by Vd value can be performed without the variation of the transistor.

Further, if variation of the voltage held in the first capacitor C1 due to leakage at the switch off time is small, the current setting period can be provided every frame or several frames. At this time, the gray-scale setting period and the light emission period can be made much longer.

Further, in place of the switch SW4, even when a third switch SW3 is provided between the second transistor Tr2 and the organic EL element LED1, the same operation and function can be realized.

Figure 17:
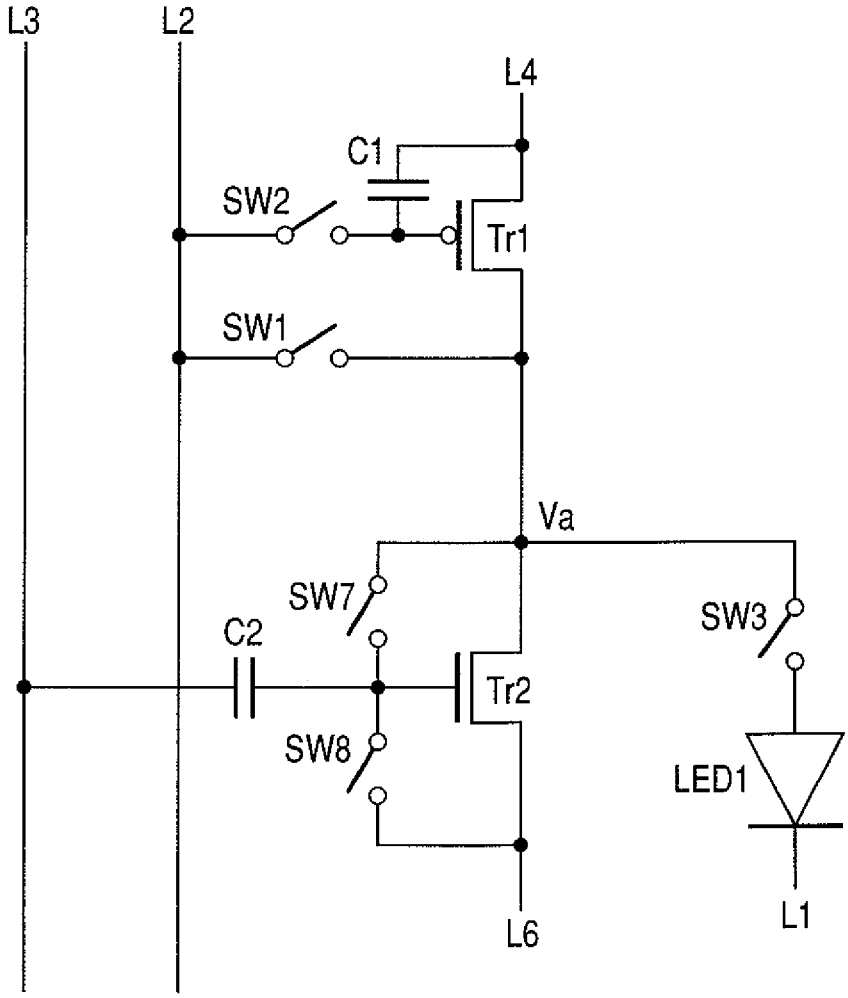
FIG. 17 is a circuit diagram illustrating an example where a switch SW8 is used in place of the switch SW4 in the fourth exemplary embodiment.
Figure 18:
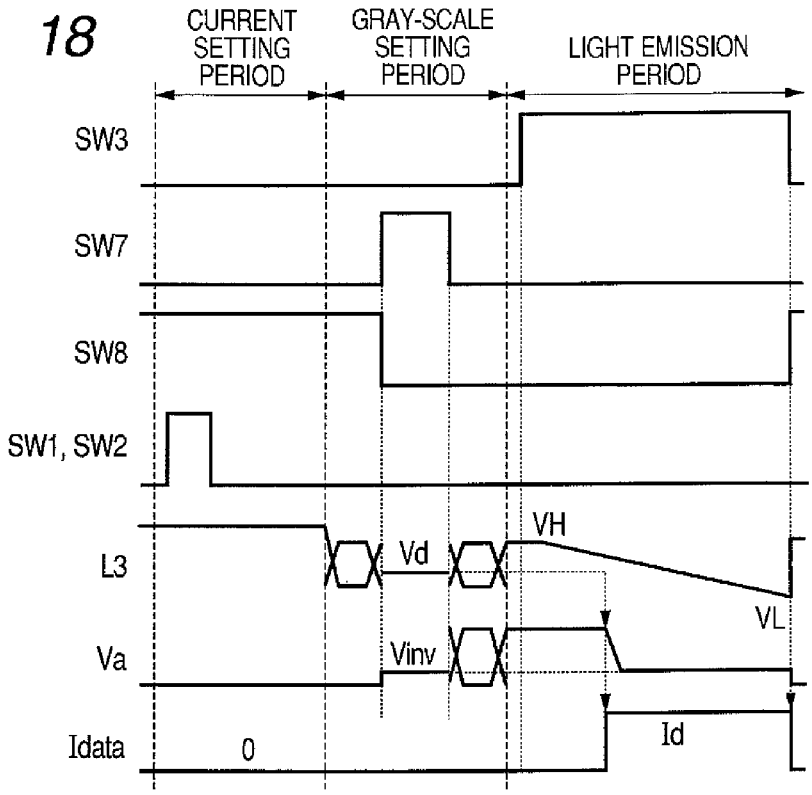
FIG. 18 is a timing chart illustrating the operation of FIG. 31.

Further, in place of the switch SW4, an eighth switch SW8 is provided between the gate and source of the second transistor Tr2 as illustrated in FIG. 17, so that the same operation can be accomplished. The timing chart in that case will be illustrated in FIG. 18. The eighth switch SW8, as illustrated in FIG. 18, is turned on during the current setting period, and is turned off during the gray-scale setting period and the light emission period.

Further, similarly to the first exemplary embodiment, as the first transistor Tr1, an N-type transistor can be used in place of the P-type transistor. In that case, as described above, the transistor Tr1 and its periphery may be configured similarly to FIGS. 3 and 5.

Further, even when the switch SW2 existing between the line L2 and the gate of the first transistor Tr1 is placed between the drain and gate of the first transistor Tr1, the same operation and function can be realized. This holds true for the case where the first transistor Tr1 is either the P-type or the N-type.

Further, when the first transistor Tr1 is the N-type transistor, except for the current setting period, but at least in the light emission period, the line L2 is applied with the VDD1, and the switch SW1 is turned on. By so doing, the same function can be realized without using the line L4 and the switch SW9. Here, it is desirable for the second transistor Tr2 to have a characteristic which comes to be in a sub threshold region equal to or less than a threshold value in the constant current to be supplied to the organic EL element LED1. In this case, the second transistor Tr2 is turned on or off by a slight change of the gate voltage of the second transistor Tr2, whereby it is possible to rapidly change whether or not to supply the current to the organic EL element LED1. Further, if an OFF current of the second transistor Tr2 is set to be equal to or less than 0.1% of the constant current, it does not influence the gray-scale control.

Incidentally, it is necessary to sufficiently increase the current ability of the second transistor Tr2 so that the second transistor Tr2 may be in the sub threshold region in the constant current. This can be achieved if the large-sized transistor is used, or if the transistor including a high-mobility semiconductor as the channel film is used.

Further, the present invention disposes the organic EL element LED1 such as described above and the light emission display element including the driving circuit on a substrate in a matrix pattern. The current setting period and gray-scale setting period are performed every line, and the line L3 is prepared every column to supply the gray-scale voltage, so that a matrix type light emission display element (image forming apparatus) can be realized.

Fifth Exemplary Embodiment

By using FIG. 19, a driving circuit according to the present exemplary embodiment and its components will be described.

Here, the driving circuit referred to here means a circuit for performing a driving control including a first period for setting a current to be supplied to a display element, a second period for setting a gray-scale of the display element, and a third period for supplying a driving current to the display element.

Figure 19:
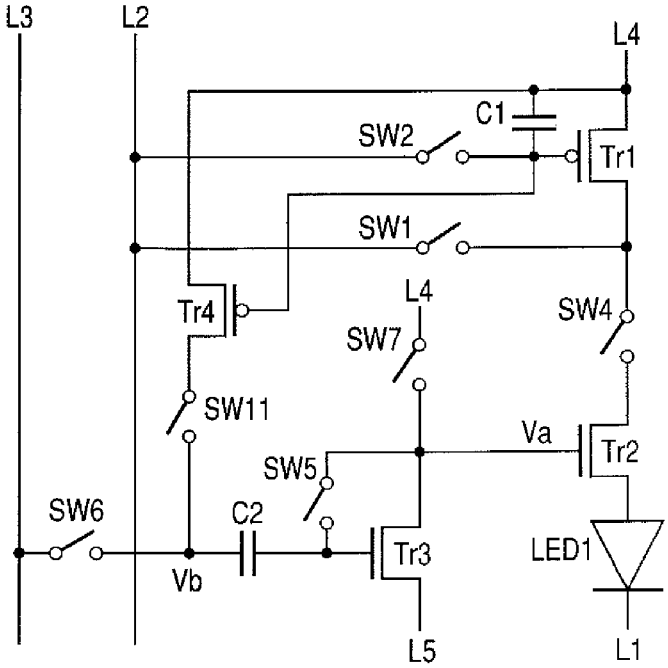
FIG. 19 is a circuit diagram illustrating the configuration of a fifth exemplary embodiment of the present invention.

As illustrated in FIG. 19, the driving circuit comprises a current source circuit having a first transistor (Tr1) and a holding circuit (For example, C1) for holding a gate voltage of the first transistor during the first period at a voltage according to a constant current supplied to the display element.

Further, the driving circuit includes a second transistor (Tr2) for switching the current from the current source circuit to the display element (LED1), a third transistor (Tr3) whose one terminal is connected to a gate of the second transistor, and a capacitor element (C2) whose one end is connected o a gate of the third transistor and whose another end is connected to a wring through a switch (SW6), and comprises a control circuit for controlling the emission time of the display element by controlling the second transistor during the second period.

Then, during the second period, an electric charge based on the difference between the gray-scale voltage supplied from with line to the capacitor element (C2) and a threshold value voltage of the third transistor is accumulated.

After that, during the third period, the control terminal of the second transistor (Tr2) is applied with an ON voltage, and at the same time, the capacitor element is applied with a sweep voltage.

By such a configuration, the ON time of the second transistor (Tr2) is controlled.

Next, by using the driving circuit and the timing chart (FIG. 20) illustrated in FIG. 19, the invention according to the present exemplary embodiment will be described more in detail.

A configuration of a fifth exemplary embodiment of the present invention will be illustrated in FIG. 19. The present exemplary embodiment is provided with an organic EL element LED1 whose one end is connected to a line L1 and its driving circuit. The driving circuit is configured as follows.

First, a P-type transistor Tr1 is provided, which is a first transistor whose source is connected to one end of a first capacitor C1 and a fourth line L4, and whose gate is connected to the other end of the first capacitor C1. Further, a first switch SW1 whose one end is connected to a drain of the first transistor Tr1 and whose another end is connected to a second line L2, and a second switch SW2 whose one end is connected to a gate of the first transistor Tr1 and whose another end is connected to a line L2 are provided.

These first transistor Tr1, first capacitor C1, first switch SW1, and second switch SW2 configure the current source circuit.

Further, the driving circuit is provided with a fourth switch SW4 whose one end is connected to the drain of the first transistor Tr1. Further, the driving circuit is provided with an N-type transistor Tr2, which is a second transistor whose source is connected to one end of the side not connected to a line L1 of the organic EL element LED1 and whose drain is connected to the drain of the first transistor Tr1 through the fourth switch SW4.

Further, the driving circuit is provided with a second capacitor C2 whose one end is connected to a gate of a second transistor Tr2 through a fifth switch SW5 and whose another end is connected to a third line L3 through a sixth switch SW6.

Further, the driving circuit is provided with a third transistor Tr3 whose one end from among the drain and source is connected to a line L5 and whose gate is connected to one end of a capacitor C2, and whose one end of the side not connected to the line L5 of the drain or source is connected to the gate of the transistor Tr2. The third transistor Tr3 is an N-type transistor.

Further, the driving circuit is provided with the seventh switch SW7 whose one end is connected to the gate of the second transistor Tr2 and whose another end is connected to the line L4, and a fourth transistor Tr4 whose source is connected to the line L4 and whose gate is connected to the gate of the first transistor Tr1. The fourth transistor Tr4 is an P-type transistor. The drain of the fourth transistor Tr4 is connected to one end of the second capacitor C2 through an eleventh switch SW11, and further connected to a line L13 through the switch SW6.

These second, third, fourth transistors Tr2, Tr3, and Tr4, second capacitor C2, switches SW4 to SW7, and switch SW11 configures the control circuit for controlling the light emission time of the organic EL element LED1.

Figure 20:
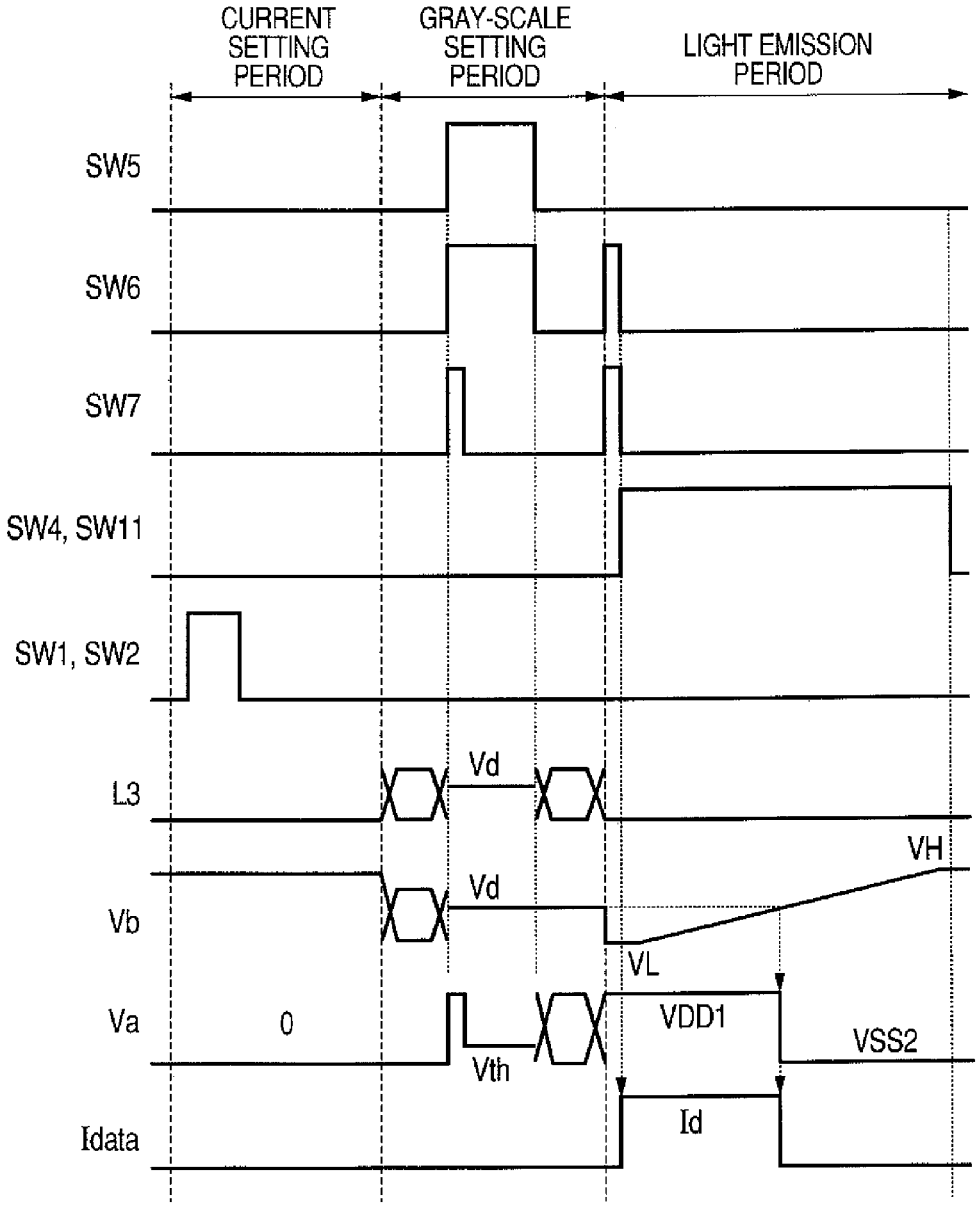
FIG. 20 is a timing chart illustrating the operation of the fifth exemplary embodiment.

A timing chart of the operation of the present exemplary embodiment will be illustrated in FIG. 20. However, the lines L1, L4, and L5 are applied with constant voltages VSS1, VDD1, and VSS2, and the line L2 is supplied with a constant current Id. Further, a gate voltage of the second transistor Tr2 is taken as a Va, and the voltage of one end of the second capacitor C2 connected to the line L3 through the switch SW6 is taken as a Vb.

First, as illustrated in FIG. 20, in the current setting period, the switches SW1 and SW2 are turned on, and the switches SW4, SW5, SW6, SW7, and SW11 are tuned off. At this time, the first transistor Tr1 is supplied with the current Id from the line L2, and in a stable state, the gate voltage of the first transistor Tr1 becomes a voltage by which the current Id is let flow. After that, since the switches SW1 and SW2 are turned off along with the termination of the current setting period, a voltage to let flow the current Id is held in the gate of the first transistor Tr1 and the first capacitor C1.

Figure 22:
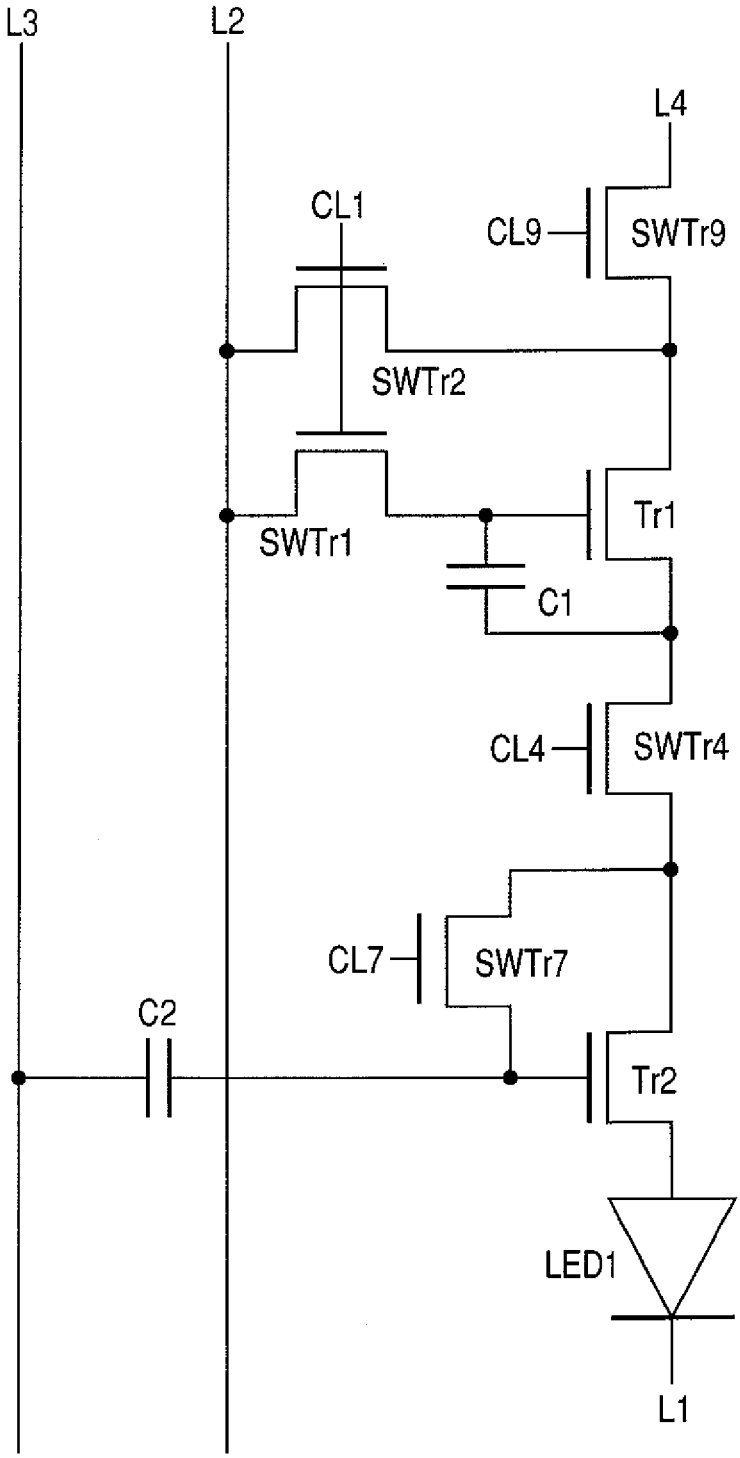
FIG. 22 is a circuit diagram illustrating an example where the switch and the transistor are configured only by n-type transistors in the third exemplary embodiment of the present invention.
Figure 23:
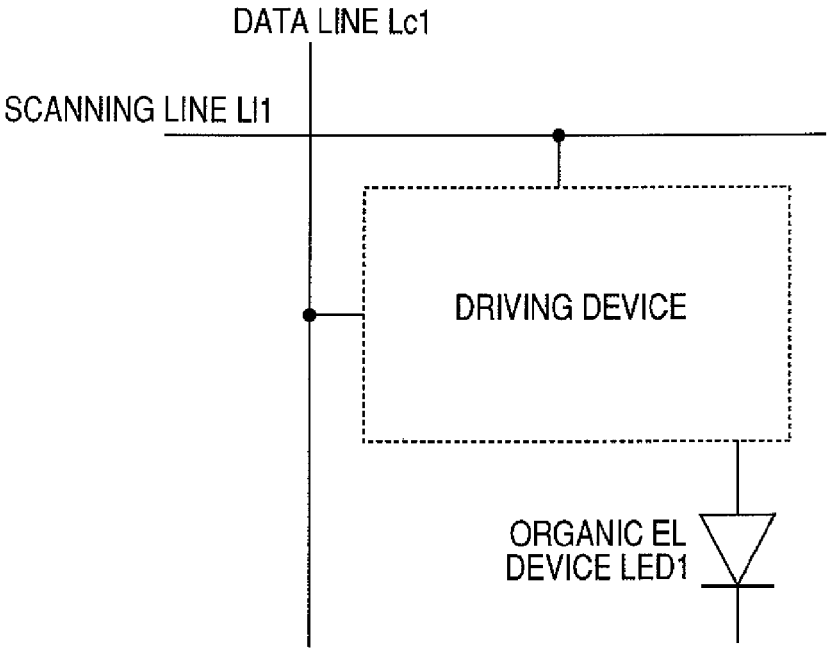
FIG. 23 is a view illustrating an example of a pixel comprising an organic EL element and a driving circuit.
Figure 24:
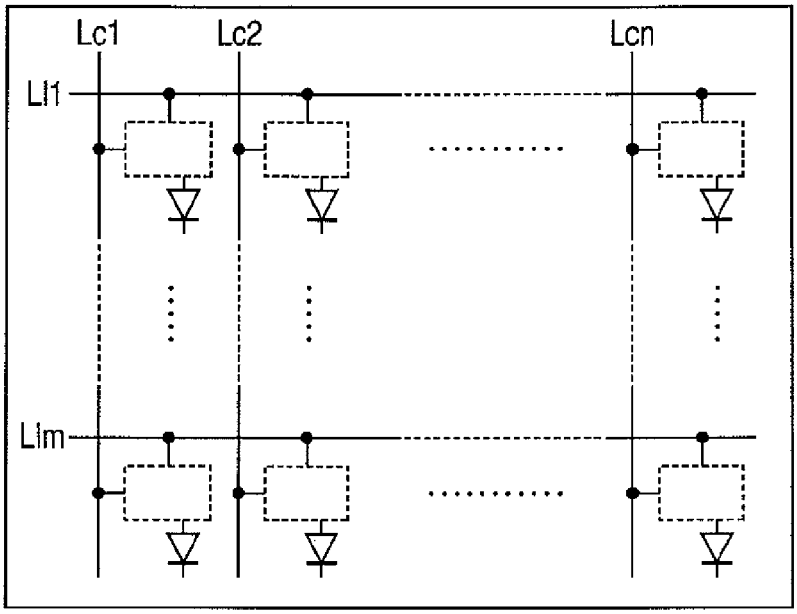
FIG. 24 is a view illustrating an example of an AM type organic EL display apparatus.
Figure 25:
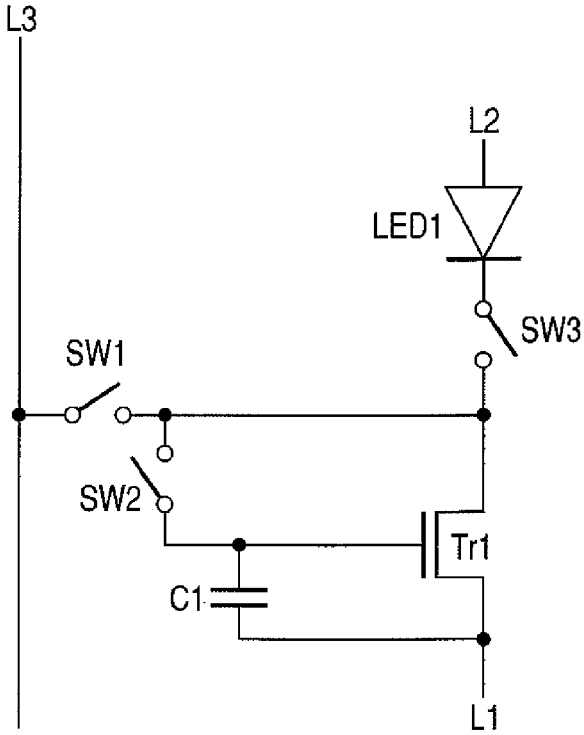
FIG. 25 is a circuit diagram illustrating a first conventional technique.
Figure 26:
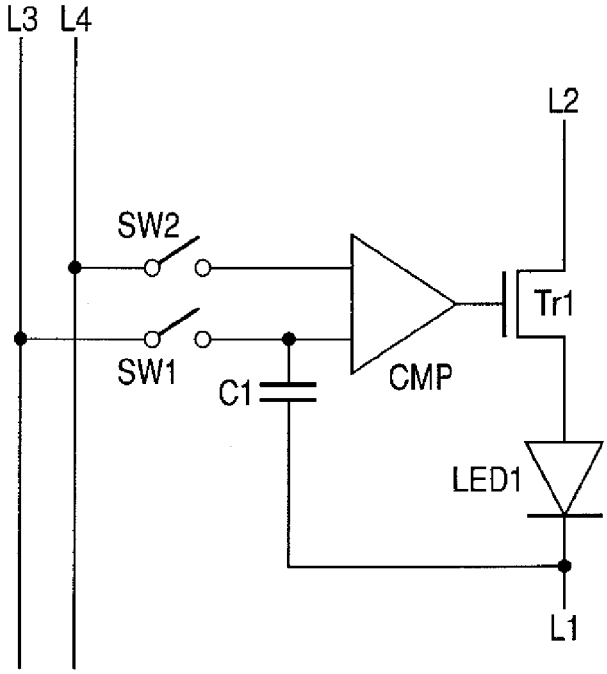
FIG. 26 is a circuit diagram illustrating a second conventional technique.

Next, in the gray-scale setting period as illustrated in FIG. 22, first, the switches SW5, SW6, and SW7 are turned on. As a result, the voltage Va becomes close to the VDD1, and the voltage Vb becomes the Vd. However, since the switch SW4 is turned off, the organic EL element LED1 is not supplied with the current, and does not emit a light. The switch SW7 is continuously turned off.

At that time, the gray-scale voltage Vd is applied from the line L3. At this time, the voltage Va becomes a threshold value voltage Vth of the third transistor Tr3. Consequently, one end of the second capacitor C2 is applied with the voltage Vd, and another one end is applied with the voltage Vth.

At this time, the second capacitor C2, provided that a capacitance value of the capacitor C2 is taken as C2, is accumulated with an electric charge $Q2=C2\times(Vd-Vth)$. After that, when the switches SW5 and SW6 are turned off, the voltages Va and Vb holds the Vth and Vd, and the second capacitor C2 holds the Q2.

Next, as illustrated in FIG. 20, in the light emission period, first, the switches SW6 and SW7 are turned on. However, the VL is applied from the line L3. As a result, the voltage Va becomes the VDD1, and the voltage Vb becomes the VL. Subsequently, the switches SW6 and SW7 are turned off, and after that, the switches SW4 and SW11 are turned on. Then, the electric charge is injected from a fourth transistor Tr4, and the voltage Vb gradually fluctuates up to the VH from the VL. However, the VH is a voltage decided by the threshold characteristic of the fourth transistor Tr4.

At this time, due to the charge pump effect in which the second capacitor C2 holds the Q2, in the range where the Vb is not more than the Vd from the VL, the gate voltage of the third transistor Tr3 becomes not more than the Vth. At this time, the voltage Va holds the VDD1, and since the second transistor Tr2 is turned on, the organic EL element LED1 is supplied with the current Id, and emits a light.

In like manner, when the Vb becomes not less than the Vd, the gate voltage of the third transistor Tr3 becomes not less than the Vth, and therefore, the voltage Va becomes the VSS2. At this time, since the second transistor Tr2 is turned off, the organic EL element LED1 is not supplied with the current, and does not emit a light.

As a result, even when variation exists in the Vth which is the characteristic of the third transistor Tr3, the second transistor Tr2 can be controlled from ON to OFF according the gray-scale voltage Vd applied from the line L3 at the gray-scale setting time. Hence, a control of the period in which the organic EL element LED1 emits a light by the Vd value can be performed without depending on the variation of the transistor.

Further, even when a line load such as an increase of the screen size increases by sweeping the voltage Vb of the second capacitor C2 by using a current source transistor Tr4 during the light emission period, the sweep voltage can be applied in all the regions. Hence, luminance does not vary due to the position on the screen, and display accuracy doe not deteriorate. Here, it is desirable for the second transistor Tr2 to have a characteristic which comes to be in a sub threshold region equal to or less than a threshold value in the constant current to be supplied to the organic EL element LED1. In this case, the second transistor Tr2 is turned on or off by a slight change of the gate voltage of the second transistor Tr2, whereby it is possible to rapidly change whether or not to supply the current to the organic EL element LED1. Further, if an OFF current of the second transistor Tr2 is set to be equal to or less than 0.1% of the constant current, it does not influence the gray-scale control.

Incidentally, it is necessary to sufficiently increase the current ability of the second transistor Tr2 so that the second transistor Tr2 may be in the sub threshold region in the constant current. This can be achieved if the large-sized transistor is used, or if the transistor including a high-mobility semiconductor as the channel film is used.

Incidentally, in the present exemplary embodiment, while a light emission period control is performed based on the first exemplary embodiment by using the current (electric charge) from the current source transistor Tr4, the similar light emission period control can be applied also to the second, third, and fourth exemplary embodiments.

Further, the present invention disposes a light emission display element including the above described organic EL element LED1 and its driving circuit on a substrate in a matrix pattern. The current setting period and gradating setting period are set up every line, and the line L3 is prepared every column to supply the gray-scale voltage, so that a matrix type light emission display element (image display apparatus) can be realized.

Further, in the first to fifth exemplary embodiments of the present invention, the transistors defined as the N-type transistor and the P-type transistor can use the transistors having reverse polarity by changing a polarity of the applied voltage and the connection of the organic EL element or the like.

Figure 21:
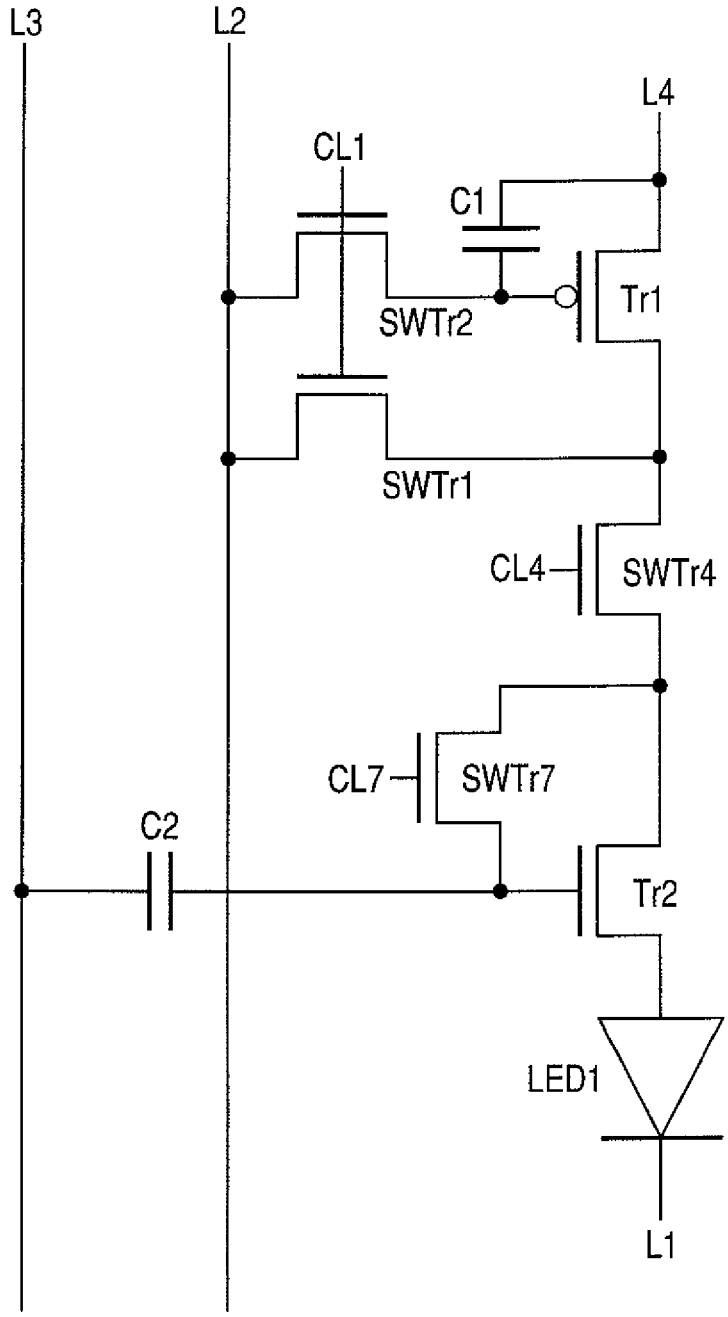
FIG. 21 is a circuit diagram illustrating an example where a switch is configured by a transistor in the third exemplary embodiment of the present invention.

Further, each switch SW can be configured by the transistor. For example, in the third exemplary embodiment, an example is illustrated in FIG. 21 where the switch is configured by the transistor.

For example, the switch SW1 of the third exemplary embodiment corresponds to a SWTr1 which operates by a CL1. Since all the switches are N-type transistors, according to the timing chart of the switch, are short-circuited at H, and are opened at L. Consequently, when all the switches operate according to FIG. 12 (timing chart of the third exemplary embodiment), the operation and function as described in the third exemplary embodiment can be performed.

Further, in the first and fifth exemplary embodiments of the present invention, the transistors and switches can be configured only by the N-type transistor and the P-type transistor. For example, in the third exemplary embodiment, one example is illustrated in FIG. 22, where the transistors are configured only by the N-type transistor.

Here, in the present invention, since it is a constant current that is supplied to the organic EL element from the current source circuit, an effect of controlling an adverse influence of the deterioration of the characteristic for the voltage can be obtained. Further, since the constant current is the maximum value supplied to the organic EL element, the load can be driven at a high speed.

Further, the gate of the first transistor Tr1 in the current source circuit, in the period in which the current is supplied to the organic EL element, is separated from other portions except for one end of the first capacitor C1. Hence, if the voltage at the side (line L4) different from the side connected to the first transistor in the drain of the first transistor and the first capacitor C1 is constant, the gate voltage of the first transistor becomes stable, and the current to the organic EL element from the current source circuit becomes stable.

Further, by using the switch (SW4) between the current source circuit and the organic EL element, an effect of controlling an excessive current to the organic EL element can be obtained.

Further, as illustrated in FIG. 19, a current source different from the current source circuit is connected to one end of the second capacitor C2, and the electric charge is injected or taken out from the current source, so that one end voltage of the second capacitor can be fluctuated. Consequently, since the voltage of one end of the second capacitor can be fluctuated in each pixel, a large size image display apparatus having a large line load can also control a change of luminance due to the position on the screen.

Further, in all the embodiments as described above, all the transistors including the switches can use a field effect transistor using silicon crystal for the channel and a thin film transistor using amorphous silicon, poly-silicon, organic semiconductor, oxide semiconductor and the like for the channel. Particularly, by using the thin film transistor, a large size matrix type light emission display element (image display apparatus) can be fabricated on a glass or plastic substrate.

Further, an amorphous oxide semiconductor which is less than $10^{18}(cm^{-3})$ in carrier density is used, so that the matrix type light emission display element can be fabricated by the thin film transistor, which is higher than the amorphous silicon thin film transistor in mobility and little in current of the off time and capable of forming the room temperature. Since the amorphous oxide semiconductor is high in mobility, and can perform circuit operations at a high speed, it can fabricate a large seize, high definition, and moderate-priced image display apparatus. Incidentally, when an amorphous oxide semiconductor material including In and Zn is used for the channel, the carrier electron density is set not more than $10^{18}(cm^{-3})$, and is preferably set not more than $10^{17}(cm^{-3})$, and more preferably set not more than $10^{16}(cm^{-3})$.

Incidentally, even when a transparent amorphous oxide as disclosed in International Publication No. 2005/088726 is used for a TFT active layer, the concept of a repair circuit can be introduced. For example, as a driving TFT of the display element such as the organic EL, a plurality of TFT is prepared within one pixel, and when a faulty point is found, a spare TFT is used by using an excimer laser.

More specifically, as a switching transistor every pixel, two pairs of TFTs are prepared, and as a TFT for driving the organic EL (diode), two pairs of TFTs are prepared. When no faulty point is found, from among the two pairs, the one pair becomes dummy TFTs. When the one pair is of transparent TFT, even when a plurality of TFTs is prepared for repair, a ratio of aperture is not greatly affected. Incidentally, the repair circuit is described in detail in Japanese Patent Application Laid-Open No. 2000-227769.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2006-065902, filed Mar. 10, 2006 which is hereby incorporated by reference herein in its.

The invention claimed is:

1. A driving circuit of a display element for performing a driving control including a first period for setting a current to be supplied to the display element, a second period for setting a gray-scale of the display element, and a third period for supplying a driving current to the display element, comprising:

a current source circuit having a first transistor and a holding circuit for holding a gate voltage of the first transistor during the first period at the voltage corresponding to a constant current to be supplied to the display element; and a control circuit including a second transistor connected in series between the current source circuit and the display element, a third transistor whose one terminal is connected to a gate of the second transistor, and a capacitor element whose one end is connected to a gate of the third transistor and the other end is connected to a line, and controlling a light emission time of the display element by controlling the second transistor during the third period, wherein, during the second period, the gate and the one terminal of the third transistor are short-circuited to set a gate voltage of the third transistor to a threshold value voltage of the third transistor and a gray-scale voltage is supplied from the line to the other end of the capacitor, whereby an electric charge is stored in the capacitor element based on the difference between the gray-scale voltage supplied to the capacitor element from the line and a threshold voltage of the third transistor, and wherein, during the third period, a sweep voltage is applied from the line to the other end of the capacitor element, so that the ON time of the second transistor is controlled.

2. The driving circuit according to claim 1, wherein a voltage to turn on the second transistor is applied to the gate of the second transistor, and after that, the sweep voltage is applied to the capacitor element so that the second transistor persists ON until the sweep voltage crosses the gray-scale voltage.

3. The driving circuit according to claim 2, wherein the voltage to turn on the second transistor is applied through the third transistor.

4. The driving circuit of the display element according to claim 1, wherein the first to third transistors and the switch element are thin film transistors made of an amorphous oxide semiconductor film.

5. The driving circuit of the display element according to claim 4, wherein the thin film transistors are n-type thin film transistors or p-type thin film transistors.

6. The driving circuit of the display element according to claim 1, wherein the display element is an organic electroluminescence element.

7. The driving circuit according to claim 1, wherein the sweep voltage is applied to the capacitor element so that the second transistor turns ON when the sweep voltage crosses the gray-scale voltage.

8. A driving circuit of a display element for performing a driving control including a first period for setting a current to be supplied to the display element, a second period for setting a gray-scale of the display element, and a third period for supplying a driving current to the display element, comprising:

a current source circuit having a first transistor and a holding circuit for holding a gate voltage of the first transistor during the first period at an electric potential corresponding to a constant current to be supplied to the display element, and a control circuit including a second transistor connected in series between the current source circuit and the display element and a capacitor element whose one end is connected to a gate of the second transistor and the other end is connected to a line, and controlling a light emission time of the display element by controlling the second transistor during the third period, wherein, during the second period, the gate and a drain of the second transistor are short-circuited to set a voltage of the gate of the second transistor to a first voltage that would allow the constant current to flow through the second transistor and a gray-scale voltage is supplied from the line to the other end of the capacitor, thereby a difference between the gray-scale voltage and the first voltage is stored to the capacitor element, and wherein a sweep voltage is applied to the other end of the capacitor element from the line during the third period, so that the ON time of the second transistor is controlled.

9. The driving circuit of a display element according to claim 8, wherein the current source circuit and the control circuit are connected by a switch.

10. The driving circuit of a display element according to claim 8, wherein the control circuit and the display element are connected by a switch.

11. The driving circuit of a display element according to claim 8, wherein, during the first period, a voltage supplied to the current source circuit is changed to inhibit the constant current to flow in the display element.

12. The driving circuit of the display element according to claim 8, wherein the first and second transistors are thin film transistors made of an amorphous oxide semiconductor film.

13. The driving circuit of the display element according to claim 12, wherein the thin film transistors are n-type thin film transistors or p-type thin film transistors.

14. The driving circuit of the display element according to claim 8, wherein the display element is an organic electroluminescence element.

* * * * *